US006356735B1

(12) United States Patent
Hozumi

(10) Patent No.: US 6,356,735 B1
(45) Date of Patent: Mar. 12, 2002

(54) SHEET TRANSPORT DEVICE AND AN IMAGE-FORMING APPARATUS EMPLOYING THE SHEET TRANSPORT DEVICE

(75) Inventor: Shinji Hozumi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/521,669

(22) Filed: Mar. 8, 2000

(30) Foreign Application Priority Data

Jun. 15, 1999 (JP) ..... 11-168947

(51) Int. Cl.[7] ..... G03G 15/00
(52) U.S. Cl. ..... 399/395; 271/228; 399/394
(58) Field of Search ..... 399/380, 388, 399/394, 395; 271/228, 248, 249, 250, 251, 252

(56) References Cited

U.S. PATENT DOCUMENTS

| | | | | | |
|---|---|---|---|---|---|
| 4,334,759 | A | * | 6/1982 | Clausing | 399/394 |
| 4,823,159 | A | * | 4/1989 | Yamamoto et al. | 399/394 |
| 5,078,384 | A | * | 1/1992 | Moore | 271/228 |
| 5,169,140 | A | * | 12/1992 | Wenthe, Jr. | 271/228 |
| 5,219,159 | A | * | 6/1993 | Malachowski et al. | 271/228 |
| 5,253,862 | A | * | 10/1993 | Acquaviva et al. | 271/251 |
| 5,278,624 | A | * | 1/1994 | Kamprath et al. | 399/395 |
| 5,461,469 | A | * | 10/1995 | Farrell et al. | 399/407 |
| 5,678,159 | A | * | 10/1997 | Williams et al. | 399/395 |
| 5,697,608 | A | * | 12/1997 | Castelli et al. | 271/228 |
| 5,697,609 | A | * | 12/1997 | Williams et al. | 271/228 |

FOREIGN PATENT DOCUMENTS

| | | |
|---|---|---|
| JP | A-59-4552 | 1/1984 |
| JP | A-61-249063 | 11/1986 |
| JP | A-63-185758 | 8/1988 |
| JP | B2-2632405 | 4/1997 |

* cited by examiner

*Primary Examiner*—Sandra Brase
(74) *Attorney, Agent, or Firm*—Oliff & Berridge, PLC

(57) ABSTRACT

To make it possible to transfer an image to an exact position even on a sheet of a maximum size having cutoff margins around a maximum image area of the image-forming module, the invention provides a sheet transport device (5) comprising a registration/transport member (2) provided in a sheet path upstream of a target location (P) for correctly positioning a sheet (1) in a sheet transport direction and transporting it toward the target location (P), and a sheet alignment mechanism (3) provided in the sheet path upstream of the target location (P) for moving the sheet (1) in a direction perpendicular to the sheet transport direction to align the sheet (1) to a reference position predefined for each set of sheet information. The invention also provides an image-forming apparatus incorporating the sheet transport device (5).

16 Claims, 26 Drawing Sheets

SHEET TRANSPORT DEVICE AND AN IMAGE-FORMING APPARATUS EMPLOYING THE SHEET TRANSPORT DEVICE

BACKGROUND OF THE INVENTION AND RELATED ART STATEMENT

The present invention relates to a sheet transport device for transporting each sheet to a specified target location. More particularly, the invention is concerned with a sheet transport device for an image-forming apparatus which makes it possible to transfer an image to an exact position even onto a sheet of maximum size having cutoff margins around a maximum image area, as well as with an image-forming apparatus employing the sheet transport device.

Generally, processes performed by an image-forming apparatus using electrophotographic technology are such that an electrostatic latent image corresponding to an image signal, for instance, is formed on a latent image carrier, such as a photosensitive drum, and a toner image obtained by developing the latent image is transferred onto a sheet of paper or other material, directly or indirectly by way of an intermediate image transfer device.

In this kind of image-forming apparatus, the maximum sheet size that can be used is determined by the maximum image area of the latent image carrier like a photosensitive drum on which the latent image is produced. The maximum sheet size thus determined is A3 size as defined in a Japanese Industrial Standard (JIS), for example.

To transfer an image to an exact position on a sheet, the sheet is usually aligned with a specific reference position. For example, this sheet alignment operation is achieved by a leading edge registration method in which the sheet is fed to am image transfer part after its leading edge has been correctly positioned, or by a side edge registration method in which the sheet is fed to the image transfer part after its side edge has been set to a specific side reference position.

The leading edge registration method is associated with a problem that when images are formed on both sides of the sheet, they tend to be incorrectly aligned with each other. This is because the sheet is likely to be fed obliquely in the leading edge registration method. Compared to this, the sheet is always lined up with the side reference position in the side edge registration method. Therefore, the side edge registration method is preferable in that it helps reduce misalignments of images formed on both sides of the sheet.

Also known in the prior art is an oblique feed correction technique used in sheet transport processes. This technique aligns each sheet with a specific side reference position by moving a registration roller, for instance, in a direction perpendicular to a sheet transport direction. Examples of the oblique feed correction technique are described in Japanese Laid-open Patent Publications No. 59-4552, No. 61-249063 and No. 63-185758, and Japanese Patent No. 2632405.

To further improve the performance of this kind of image-forming apparatus, those provided with various after-treatment devices, such as a stapler, a puncher and a binder, have thus far been proposed.

Under such circumstances, the inventor of the present invention fitted aftertreatment devices like a trimmer to an image-forming apparatus and examined the possibility of providing a high-accuracy printing system. Test results have proved that to obtain a maximum image area equal to JIS A3 size (297 mm wide), for example, the printing system must be able to handle a sheet as large as A3 broad size (320 mm wide), for example, which is larger than the A3 size, and trim the sheet of the A3 broad size after an image has been fixed onto it to produce a print of the standard A3 size.

To meet such requirements, there is no way but to make the maximum image area that can be handled by the image-forming apparatus larger than usable sheet sizes.

To enlarge the maximum image area, however, it is inevitable for the apparatus to become large-sized, and this would result in an increase in product cost. Moreover, development efforts for increasing the maximum image area would be enormous and time-consuming.

The maximum image area of existing image-forming apparatus designed to handle A3 size sheets is naturally the A3 size. Thus, none of the existing image-forming apparatus can handle A3 broad size sheets without extensive design change. Although the A3 broad size is only 23 mm wider than the A3 size, increasing the maximum image area of the existing image-forming apparatus by this amount would involve almost the same man-hours as would be required for developing a new image-forming apparatus. In addition, such a modification would make it necessary to redesign or newly develop almost every component.

Even when the A3 broad size sheet is used, however, a final image is not formed throughout its entire surface area but in the area of the A3 size, because portions of the sheet around the central A3 area where the image is formed serve simply as cutoff margins.

In this situation, the inventor has reached the conclusion that an image-forming apparatus intending to handle the A3 broad size sheet need not necessarily provide a maximum image area as large as the A3 broad size but may be so constructed that it can transfer an image exactly onto the central A3 area of the A3 broad size sheet by using a readily available image-forming module capable of handling the standard A3 size sheet.

SUMMARY OF THE INVENTION

The present invention has been made in view of the above circumstances and provide a sheet transport device image-forming module, wherein the sheet transport device makes it possible to transfer an image to an exact position even on a sheet of maximum size having cutoff margins around a maximum image area of the image-forming module. The invention also provides an image-forming apparatus employing the sheet transport device.

According to an aspect of the invention, a sheet transport device comprises a registration/transport member 2 provided in a sheet path upstream of a target location P for correctly positioning a sheet 1 in a sheet transport direction and transporting it toward the target location P, and a sheet alignment mechanism 3 provided in the sheet path upstream of the target location P for moving the sheet 1 in a direction perpendicular to the sheet transport direction to align the sheet 1 to a reference position predefined for each set of sheet information, as shown in FIG. 1.

While the aforementioned construction of the sheet transport device of the invention is applicable to a wide range of sheet transport devices in which the sheet 1 of paper or other material is transported toward the target location P, it is particularly effective when implemented in an image-forming apparatus which requires a high positioning accuracy of the sheet 1 in the sheet transport direction.

According to another aspect of the invention, an image-forming apparatus comprises an image carrier 5 which carries an image T formed on its image transfer part, a sheet transport device 6 which transports a sheet 1 to the image transfer part of the image carrier 5, and an image transfer element 7 which transfers the image T on the image carrier 5 onto the sheet 1 at the image transfer part, the sheet transport device 6 including a registration/transport member 2 provided in a sheet path upstream of the image transfer part for correctly positioning the sheet 1 in a sheet transport direction and transporting it toward the image transfer part, and a sheet alignment mechanism 3 provided in the sheet path upstream of the image transfer part for moving the sheet 1 in a direction perpendicular to the sheet transport direction to align the sheet 1 to a reference position predefined for each set of sheet information, as shown in FIG. 1.

While a typical example of the registration/transport member 2 that can be used in the aforementioned sheet transport device and image-forming apparatus would be a driving roller (registration drive roller) associated with a driven roller (registration idle roller) which is pressed against the driving roller to nip and transport the sheet 1, the invention is not limited to this arrangement. For example, the registration/transport member 2 may be additionally provided with a gate member for temporarily stopping the sheet 1, or other alternative arrangements may be used as appropriate.

Basically, the sheet alignment mechanism 3 is an arrangement for moving the sheet 1 in the direction perpendicular to the sheet transport direction. A characteristic feature of the sheet alignment mechanism 3 is that it aligns the sheet 1 to the reference position predefined each set of sheet information (e.g., size, orientation and type).

In one typical form of the sheet alignment mechanism 3, it utilizes the registration/transport member 2 as a constituent part, for example. Specifically, the registration/transport member 2 is fitted to the sheet alignment mechanism 3 movably in the direction perpendicular to the sheet transport direction, wherein the sheet alignment mechanism 3 moves the registration/transport member 2 from its home position in the direction perpendicular to the sheet transport direction with the sheet 1 nipped by the registration/transport member 2.

In another form of the sheet alignment mechanism 3, it is a sheet-shifting mechanism provided upstream of the registration/transport member 2 with respect to the sheet transport direction, the sheet-shifting mechanism including a movable guide which shifts the sheet 1 toward the reference position before it is nipped by the registration/transport member 2.

In still another form of the sheet alignment mechanism 3 preferable for improving sheet alignment accuracy, it includes an initial alignment mechanism which aligns a side edge of the sheet 1 to an initial side alignment position, and a reference position alignment mechanism which aligns the sheet 1 initially aligned by the initial alignment mechanism to the reference position predefined for each set of sheet information.

In one example of this form of the sheet alignment mechanism 3, the initial alignment mechanism includes an initial side alignment position setting member which defines the initial side alignment position in the direction perpendicular to the sheet transport direction, and an oblique transport member which moves the sheet 1 obliquely toward the initial side alignment position setting member.

According to a preferable method of setting the reference position for each set of sheet information, the sheet alignment mechanism 3 includes a memory storing the reference position predefined for each set of sheet information, and a sheet-shifting mechanism which shifts the sheet 1 in the direction perpendicular to the sheet transport direction to align the sheet 1 to the reference position stored in the memory, for example.

According to a preferable method of shifting the sheet 1 to the reference position, the sheet alignment mechanism 3 includes a side edge position sensor which detects the location of a side edge of the sheet 1, and a sheet-shifting mechanism which determines a side shift amount required for the sheet 1 to reach the reference position based on a sensing signal from the side edge position sensor and shifts the sheet 1 in the direction perpendicular to the sheet transport direction as much as the side shift amount.

To smoothly transport the sheet 1 by the sheet alignment mechanism 3 which utilizes the registration/transport member 2 as a constituent part, it is preferable that the registration/transport member 2 be relieved of its state of nipping the sheet 1 after a force advancing the sheet 1 has been applied to it by a transport member (which corresponds to the image transfer element 7, for example) disposed at the target location P.

Furthermore, to smoothly perform a succeeding sheet alignment operation, it is preferable that the registration/transport member 2 be relieved of its state of nipping the sheet 1 and reset to the home position after a force advancing the sheet 1 has been applied to it by a transport member (which corresponds to the image transfer element 7, for example) disposed at the target location P.

To make it possible to form an image at the center of the width of the sheet 1 in the image-forming apparatus, it is necessary for the sheet alignment mechanism 3 to have the capability of aligning a center line of the width of the sheet 1 with the reference position which is taken at a center line of the width of the image carrier 5.

Especially for forming an image at an exact position when the image-forming apparatus is of a type in which the dimension of the image carrier 5 as measured in the direction perpendicular to the sheet transport direction corresponds to that of a maximum image area, it is preferable that the sheet alignment mechanism 3 align a center line of the width of the sheet 1 with the reference position which is taken at a center line of the width of the image carrier 5 at least when the sheet 1 has a specific blank area around the maximum image area.

Furthermore, to reduce the distance of moving a small-sized sheet 1 widthwise in the sheet alignment operation performed by the sheet alignment mechanism 3 when the image-forming apparatus is of a type in which the dimension of the image carrier 5 as measured in the direction perpendicular to the sheet transport direction corresponds to that of a maximum image area, it is preferable that the sheet alignment mechanism 3 align a side edge of the sheet 1 to a side reference position when the sheet 1 is smaller than the maximum image area. This makes it possible to simplify the construction of the sheet alignment mechanism 3 and decrease its operating time.

Moreover, to prevent a problem (i.e., local deterioration of the image carrier 5) which may potentially occur due to uneven use of a surface area of the image carrier 5 when handling small-sized sheets 1, it is preferable that the sheet alignment mechanism 3 can change the reference position predefined for each set of sheet information.

The operation of the above-described sheet transport device and image forming apparatus is now explained.

As shown in FIG. 2, the registration/transport member 2 is provided upstream of a target location P and transports the sheet 1 toward the target location P to correctly position it.

At the same time, the sheet alignment mechanism 3, provided in the sheet path upstream of the target location P, moves the sheet 1 in a direction perpendicular to the sheet transport direction to align the sheet 1 to a reference position predefined for each set of sheet information.

A sheet 1 (1) smaller than a maximum image area Gmaxis moved from an initial side alignment position SIP and aligned to a reference position a1, whereas sheets 1 (2) and 1 (3) larger than the maximum image area Gmax are aligned to reference positions a2 and a3, respectively.

For the sheets 1 (2) and 1 (3) larger than the maximum image area Gmax, the reference positions are set so that an image corresponding to the maximum image area Gmax is formed in the sheet 1 (2) or 1 (3).

As stated above, the sheet alignment mechanism 3 moves the sheet 1 in the direction perpendicular to the sheet transport direction to align it to a reference position predefined for each set of sheet information in a process of transporting the sheet 1 to the target location P according to the present invention. Accordingly, if optimum reference positions are set for various types of sheets with respect to the maximum image area of a readily available image-forming module, it is possible to exactly transfer an image not only onto a sheet of any size equal to or smaller than the maximum image area but also onto a sheet of a maximum size having cutoff margins around the maximum image area of the image-forming module by using the relevant image-forming module as it is.

It will be recognized that it becomes possible to exactly transfer an image onto various types of sheets including those larger than the maximum image area of an existing image-forming module by using it as it is and just developing a sheet transport device of a new design. Therefore, it is possible to easily construct a high-performance image-forming apparatus provided with such an aftertreatment device as a trimmer without increasing the physical size of the apparatus or developing new components on an extensive scale.

BRIEF DESCRIPTION OF THE DRAWINGS

Preferred embodiments of the invention will be described, by way of example, with reference to the accompanying drawings, in which.

DETAILED DESCRIPTION OF THE PREFERRED EMBODIMENTS OF THE INVENTION

Now, the invention is described in detail in conjunction with its preferred embodiments.

FIRST EMBODIMENT

Figure 1:
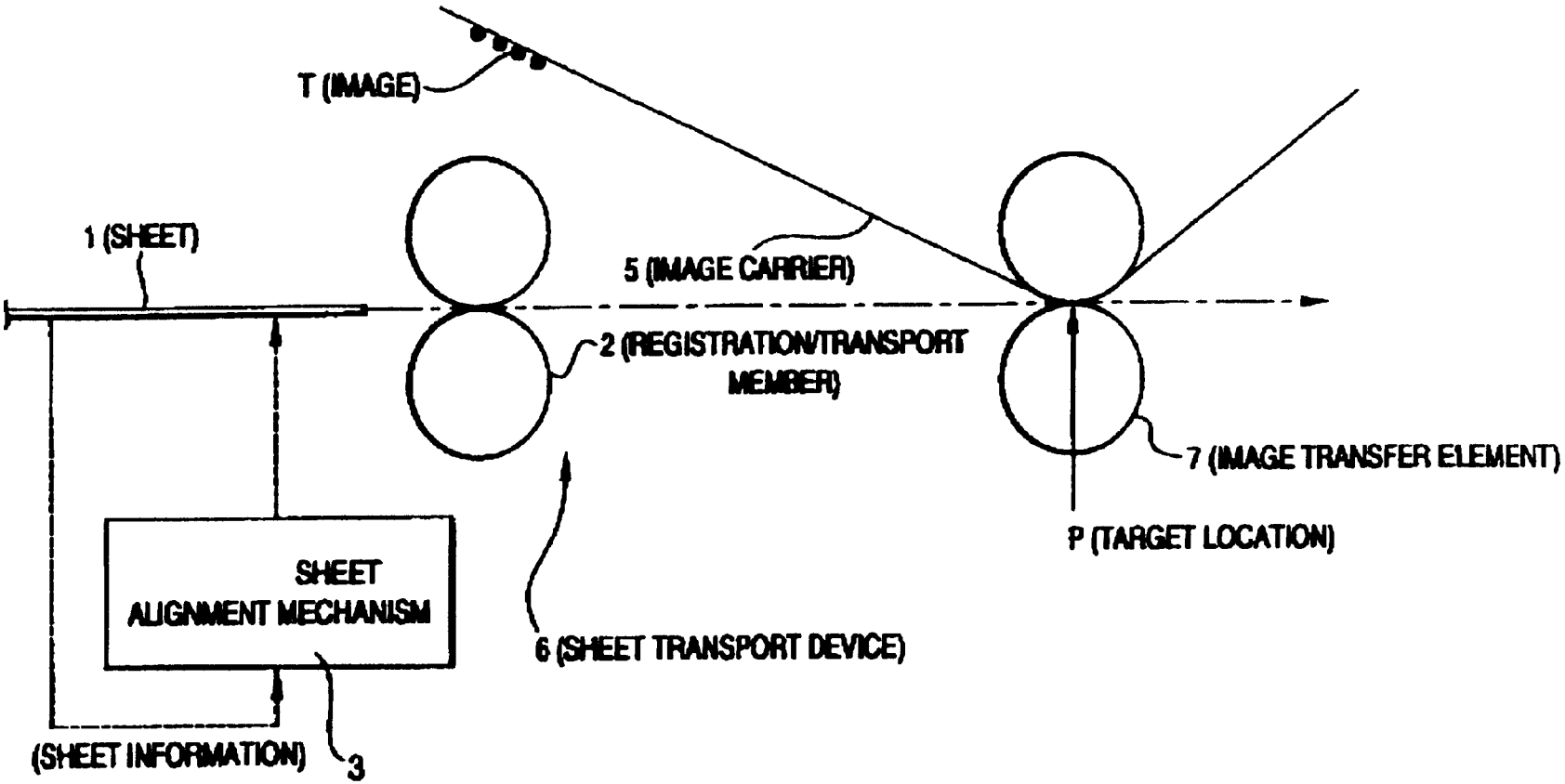
FIG. 1 is a diagram generally showing a sheet transport device according to the invention and an image-forming apparatus employing the sheet transport device.
Figure 2:
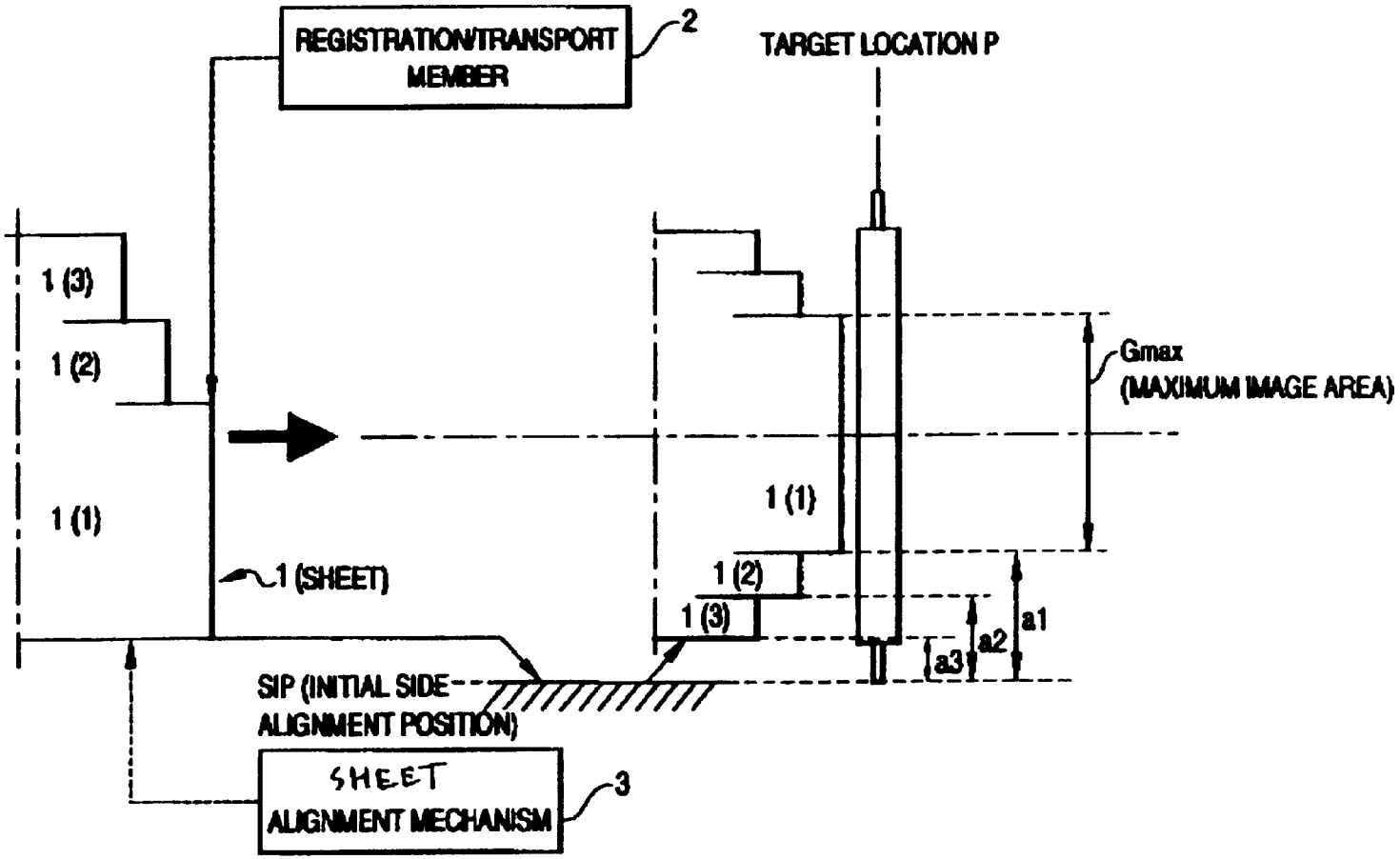
FIG. 2 is an explanatory diagram showing the operation of the sheet transport device according to the invention.
Figure 3:
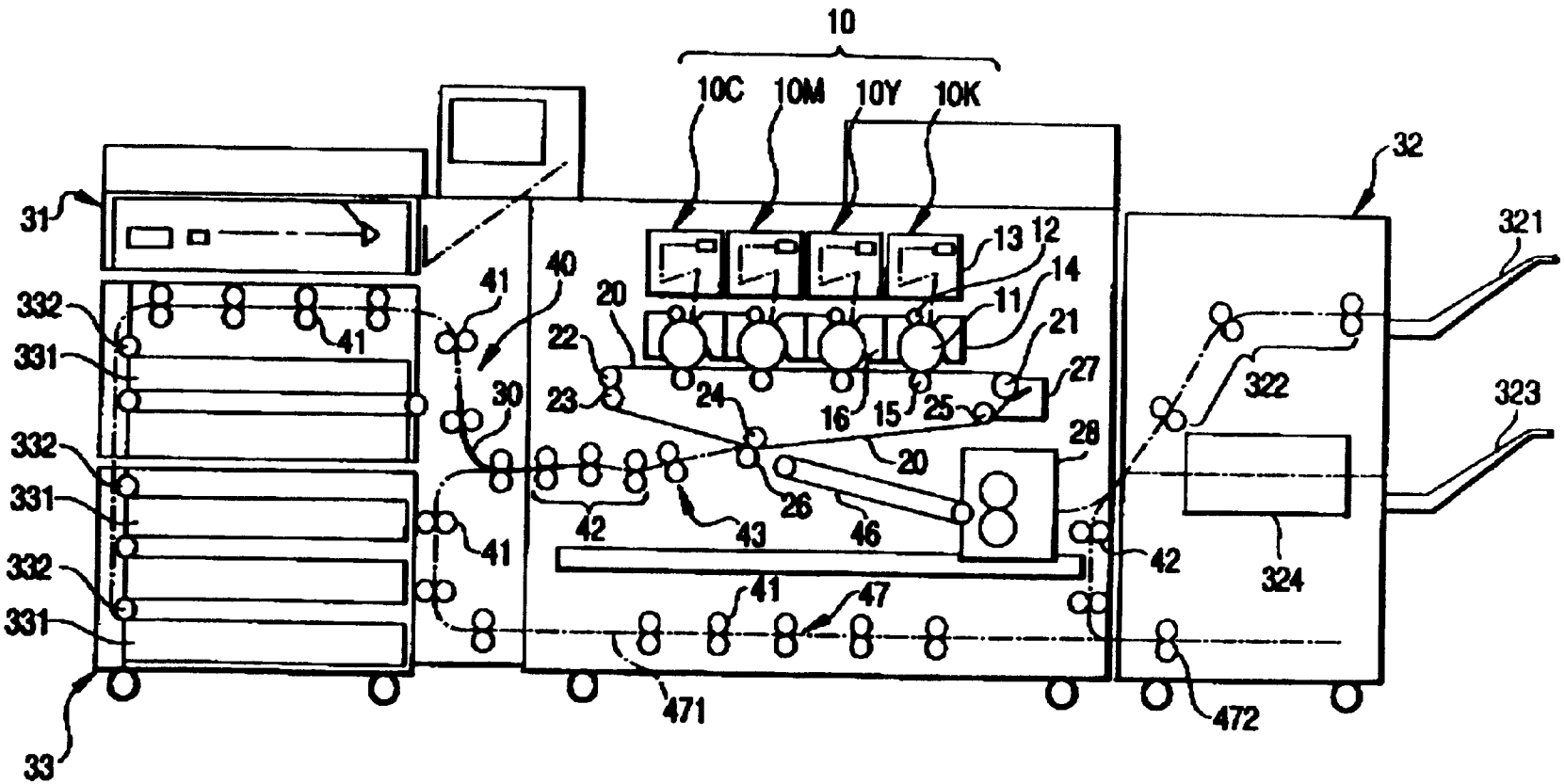
FIG. 3 is a diagram showing an image-forming apparatus according to a first embodiment of the invention.

FIG. 3 is an explanatory diagram showing an image-forming apparatus according to a first embodiment of the invention.

Referring to FIG. 3, the image-forming apparatus of this embodiment employs a so-called tandem-type intermediate transfer method, provided with multiple image-forming modules 10 which produce toner images of individual color components by using the electrophotographic technology are arranged in tandem. For example, these modules 10 include image-forming modules 10K, 10Y, 10M and 10C for producing black (K), yellow (Y), magenta (M) and cyan (C) images, respectively. The toner images of the individual color components produced by the respective image-forming modules 10 are sequentially transferred onto an intermediate image transfer belt 20 (primary image transfer). Then, a secondary image transfer roller 26 transfers the color toner images on the intermediate image transfer belt 20 onto a sheet 30 fed from one of sheet trays 331 or from a manual feed tray which is not illustrated (secondary image transfer), and a sheet transport belt 46 guides the sheet 30 into a fixing unit 28.

In this embodiment, the image-forming module 10 of each color component has a latent image carrier 11, such as a photosensitive drum, around which various electrophotographic devices are arranged in a prescribed order. The electrophotographic devices include a uniform charger 12 for uniformly charging the latent image carrier 11, a laser exposure unit 13 for producing an electrostatic latent image on the latent image carrier 11, a developing unit 14 containing toner of one color component for converting the latent image into a visual toner image, a primary image transfer roller 15 for transferring the toner image of the relevant color from the latent image carrier 11 onto the intermediate image transfer belt 20, and a cleaner 16 for removing residual toner on the latent image carrier 11, as illustrated in FIG. 3.

The intermediate image transfer belt 20 are mounted on multiple (five in this embodiment) support rollers 21–25 and turns around them. Of these support rollers 21–25, the support roller 21 serves as a driving roller while the other support rollers 22–25 act as driven rollers. Furthermore, arbitrarily selected one of these driven rollers 22–25 (the support roller 23, for example) is caused to function as a tension roller which exerts a pulling force or tension on the intermediate image transfer belt 20.

In this embodiment, a portion of the intermediate image transfer belt 20 located under the support roller 24 constitutes a secondary image transfer part (target location) P. The secondary image transfer roller 26 is placed in contact with an outside surface of the intermediate image transfer belt 20 at its secondary image transfer part P, and an image-transferring bias is applied between the secondary image transfer roller 26 and the support roller 24 which serves as a backup roller.

The numeral 27 shown in FIG. 3 designates a belt cleaner for removing residual toner and other unwanted objects on the intermediate image transfer belt 20.

The image-forming apparatus of the embodiment is further provided with an image-scanning unit 31 and an after-treatment unit 32.

The image-scanning unit 31 is constructed of such elements as a light source, a reflecting mirror, a focusing lens and a charge-coupled device (CCD) sensor to optically scan an image of an original document placed on an original glass plate.

The aftertreatment unit 32 has a sheet-ejecting assembly 322 which guides the sheet 30 output from the fixing unit 28 onto a first output tray 321 and a sheet trimmer 324 which trims the sheet 30 output from the fixing unit 28 and guides it onto a second output tray 323, as illustrated in FIG. 3. In this embodiment, the sheet trimmer 324 trims the sheet 30, if it is of the A3 broad size larger than the standard A3 size, for example, by cutting off its margins around an A3 image area.

The image-forming apparatus of the embodiment is further provided with a sheet-feeding unit 33 incorporating the multiple sheet trays 331 on which sheets 30 of various paper sizes can be stacked as well as the unillustrated manual feed tray which is used when feeding post cards, for instance, in manual feed mode. The sheet trays 331 and the manual feed tray are associated with respective feed rollers 332 for feeding the sheets 30.

The image-forming apparatus also has a sheet transport device 40 which includes an appropriate number of transport roller pairs 41. A sheet 30 fed from one of the sheet trays 331 or from the manual feed tray is first carried by the transport roller pairs 41, and a side edge of the sheet 30 is aligned with an initial alignment position SIP by multiple (e.g., three) slantwise transport roller pairs 42. Then, a registration roller pair 43 provided upstream of the secondary image transfer part P aligns the sheet 30 with a specific reference position and feeds it toward the secondary image transfer part P. The sheet 30 which has passed the secondary image transfer part P is carried downstream into the fixing unit 28 by the sheet transport belt 46, for example.

The sheet transport device 40 of the embodiment further includes a sheet return mechanism 47 which returns the sheet 30 output from the fixing unit 28 to the secondary image transfer part P with the sheet 30 turned upside down, or without tuning it upside down.

The sheet return mechanism 47 has an appropriate number of transport roller pairs 41 to carry the sheet 30 output from the fixing unit 28 along a looplike return path 471. There is provided a sheet-reversing portion 472 in the return path 471. In this embodiment, the sheet-reversing portion 472 is configured by using a lower space of the aftertreatment unit 32. When the sheet 30 is guided into the sheet-reversing portion 472, its transport direction is reversed, and when the sheet 30 is not guided into the sheet-reversing portion 472, the sheet 30 is carried in its original transport direction.

Figure 5:
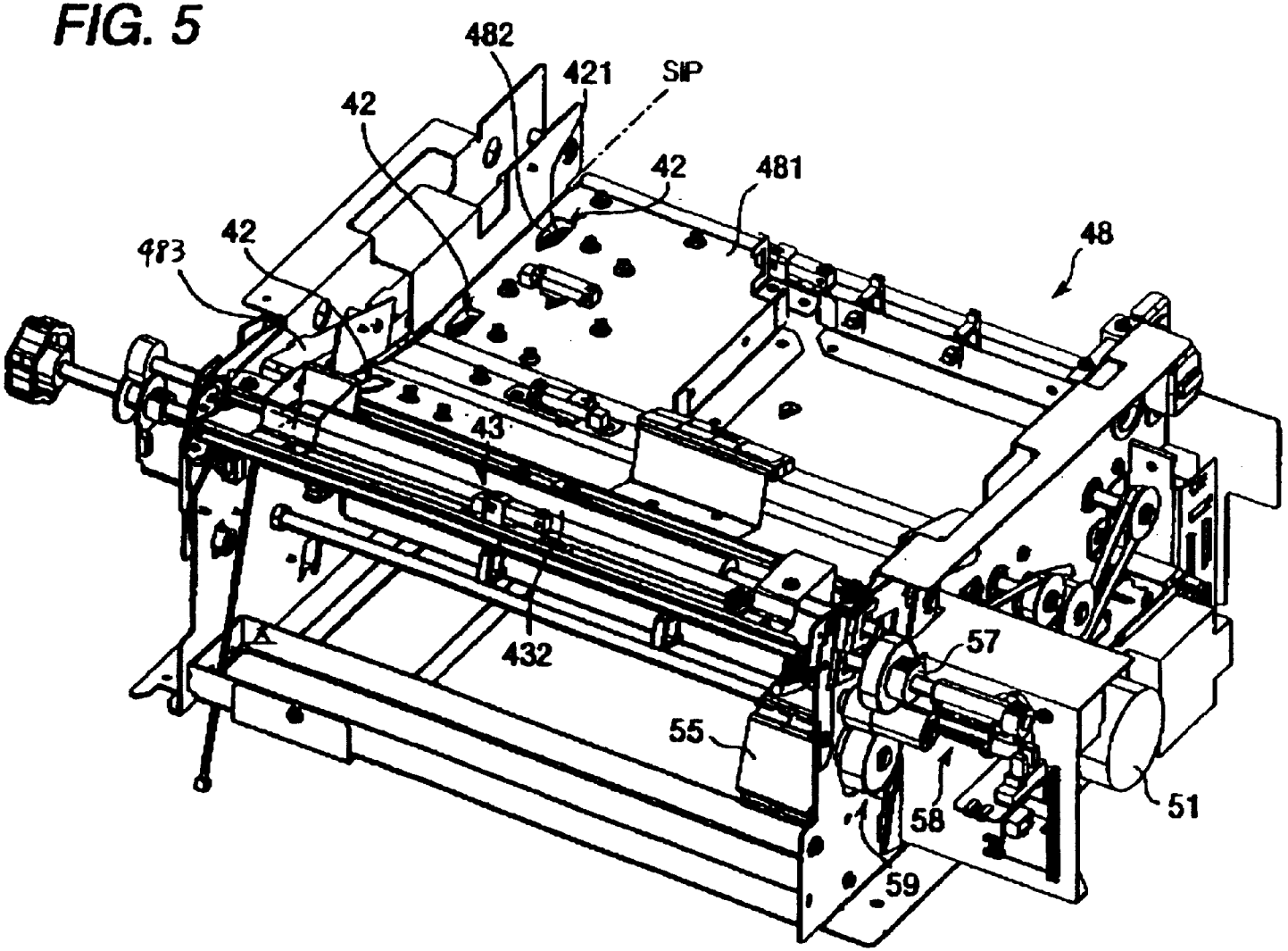
FIG. 5 is a perspective view of a sheet transport unit including registration rollers and associated components according to the first embodiment.
Figure 6A:
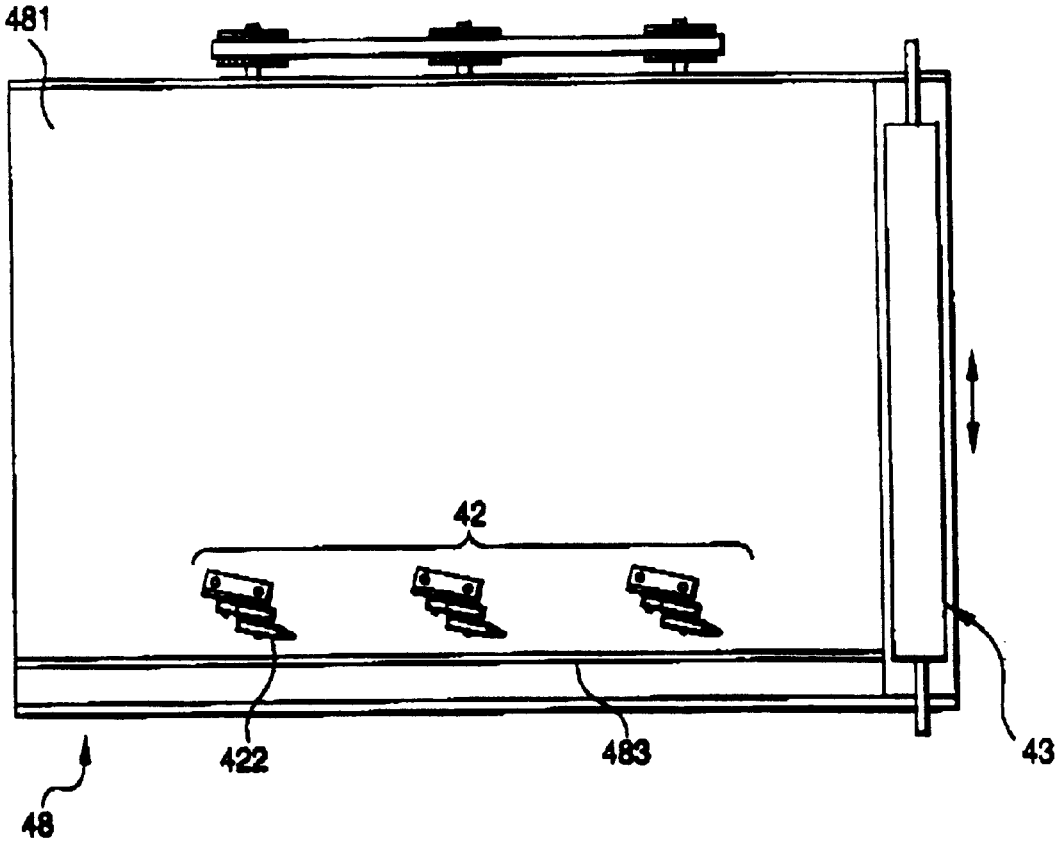
FIGS. 6A and 6B are a plan view and a front view of the sheet transport unit, respectively.
Figure 6B:
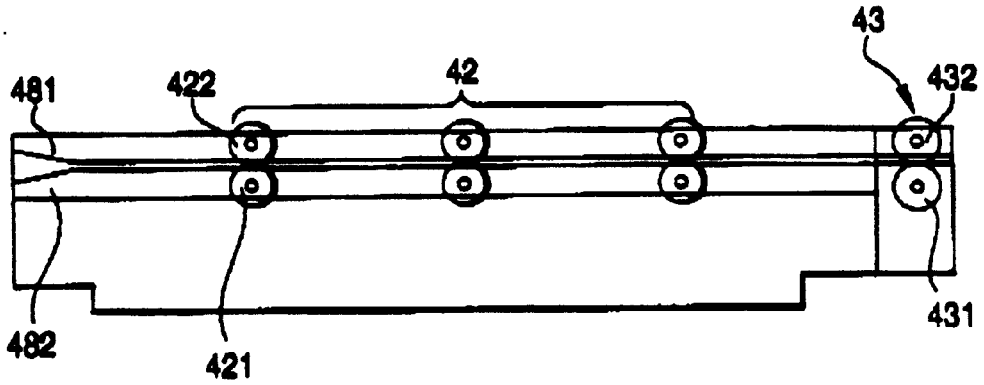

In the sheet transport device 40 of the embodiment, the aforementioned registration roller pair 43 and the multiple (three in this example) slantwise transport roller pairs 42 located upstream of the registration roller pair 43 are packed in a modular sheet transport unit 48 (as illustrated in FIGS. 5 and 6A–6B).

The sheet transport unit 48 has upper and lower guide plates 481, 482 forming a narrow passage in between for guiding the sheet 30 as well as a fixed side guide 483, which is a plate with both sides bent inside at right angles, mounted in an upright position along a sheet transport direction, wherein an inner surface of the fixed side guide 483 defines the aforementioned initial side alignment position SIP where one side edge of the sheet 30 is initially aligned.

The slantwise transport roller pairs 42 include slantwise drive rollers 421 which are mounted slightly at an oblique angle to the sheet transport direction so that their forward parts are oriented toward the fixed side guide 483 as well as slantwise idle rollers 422, as shown in FIGS. 4, 5 and 6A–6B. The slantwise drive rollers 421 are driven by a drive motor 51 which is a pulse motor, whereas the slantwise idle rollers 422 turn with the slantwise drive rollers 421 when pressed against them. The individual slantwise idle rollers 422, for example, are brought into their nip positions, that is, pressed against the slantwise drive rollers 421, and released from the nip positions by nip/release motors 52–54. The slantwise idle rollers 422 are not illustrated in FIG. 5.

Also, the registration roller pair 43 includes a registration drive roller 431 rotated by a drive motor (registration motor) 55 which is a pulse motor, for instance, and a registration idle roller 432 which turns with the registration drive roller 431 when pressed against it, as shown in FIGS. 4, 5 and 6A–6B. The registration idle roller 432, for example, is brought into its nip position, that is, pressed against the registration drive roller 431, and released from the nip position by a nip/release motor 56.

As depicted in FIGS. 4, 5, 6A–6B and 7, the individual registration rollers 431, 432 are rotatably supported by a unit frame 480 of the sheet transport unit 48 and the registration drive roller 431 is made movable in its axial direction with a side shift mechanism 58 fitted to one end of a support shaft of the registration drive roller 431 via a coupling 57.

The side shift mechanism 58 includes a rack 582 fitted on a shaft 581 which is connected to the coupling 57, a pinion 583 which is meshed with the rack 582, and a side shift motor 584 which turns the pinion 583 by a specified amount.

Figure 7:
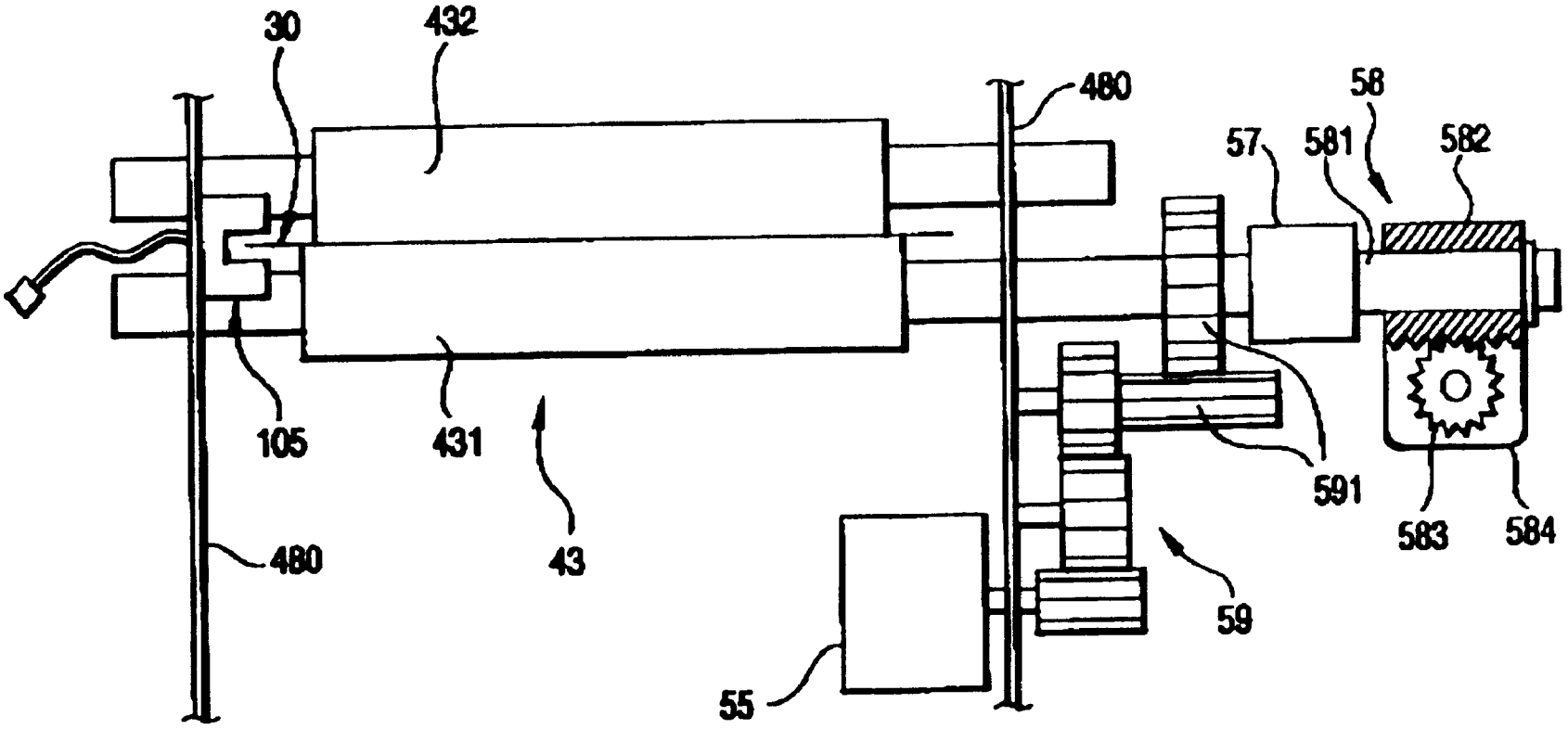
FIG. 7 is a diagram showing a side shaft mechanism for a registration roller pair of the first embodiment.
Figure 8:
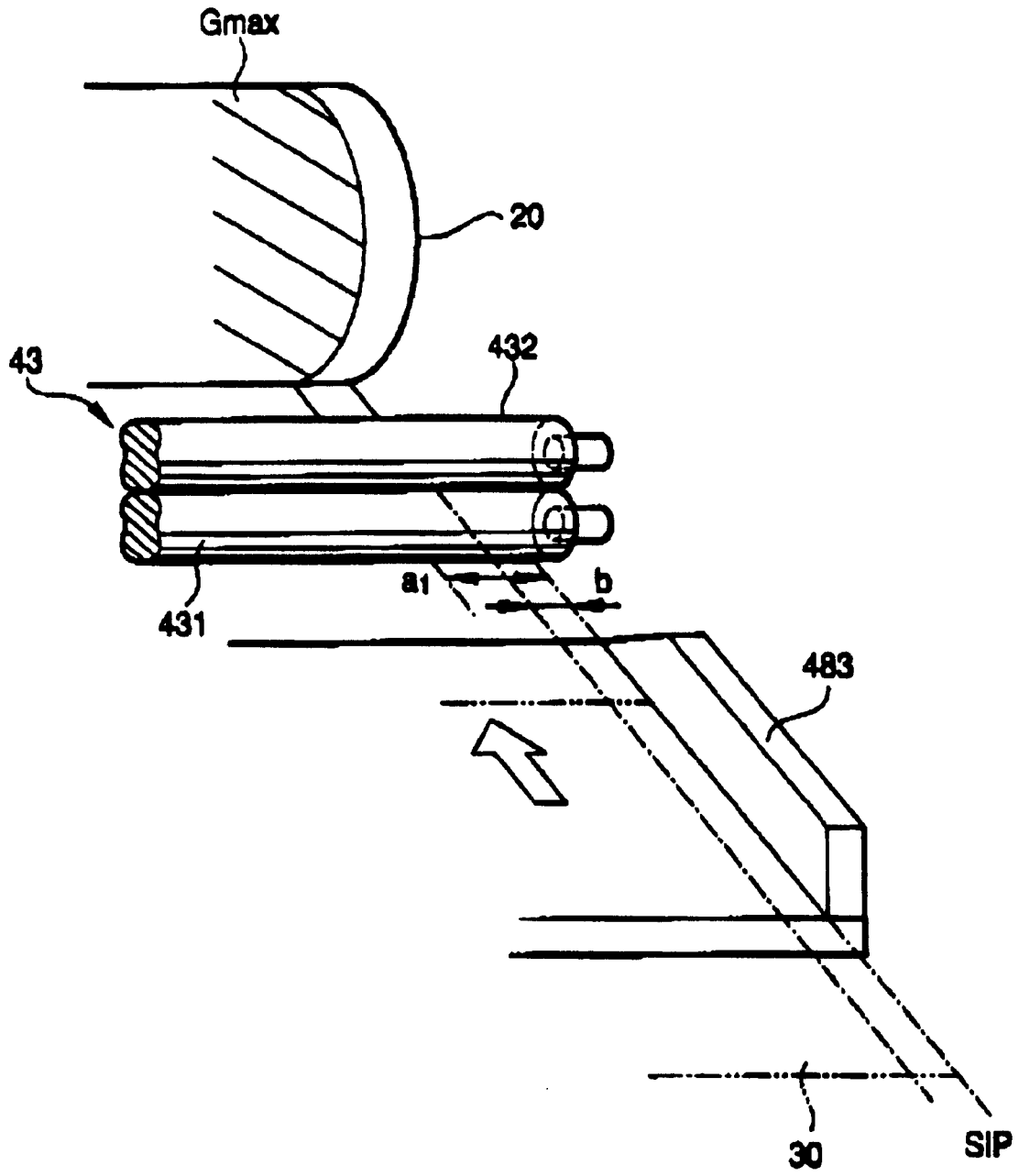
FIG. 8 is a diagram showing how a fixed side guide of the first embodiment is positioned.

As can be seen from FIG. 7, the registration motor 55 is fixed to an inside surface of the unit frame 480, and a driving force of the registration motor 55 is transmitted to the registration drive roller 431 through a reduction gear train 59. Two gears 591 of the reduction gear train 59 closer to the registration drive roller 431 are made movable relative to each other to allow the registration drive roller 431 to shift in its axial direction.

In this image-forming apparatus, the initial side alignment position SIP defined by the fixed side guide 483 lies a distance a1 apart from a side boundary of a maximum image area Gmax allowed by the image-forming modules 10, where the side boundary corresponds to a standard side reference position and the distance a1 is 16.52 mm in this embodiment. The maximum image area Gmax corresponds to a maximum latent image forming area on a curved surface of the latent image carrier 11, which is the standard A3 size.

The width of the intermediate image transfer belt 20 is made such that the maximum image area Gmax lies in its central portion, leaving blank spaces 20*a* on both sides. Thus, a side edge of the intermediate image transfer belt 20 is located a specified distance b (5 mm in this embodiment) apart from the initial side alignment position SIP.

Figure 4:
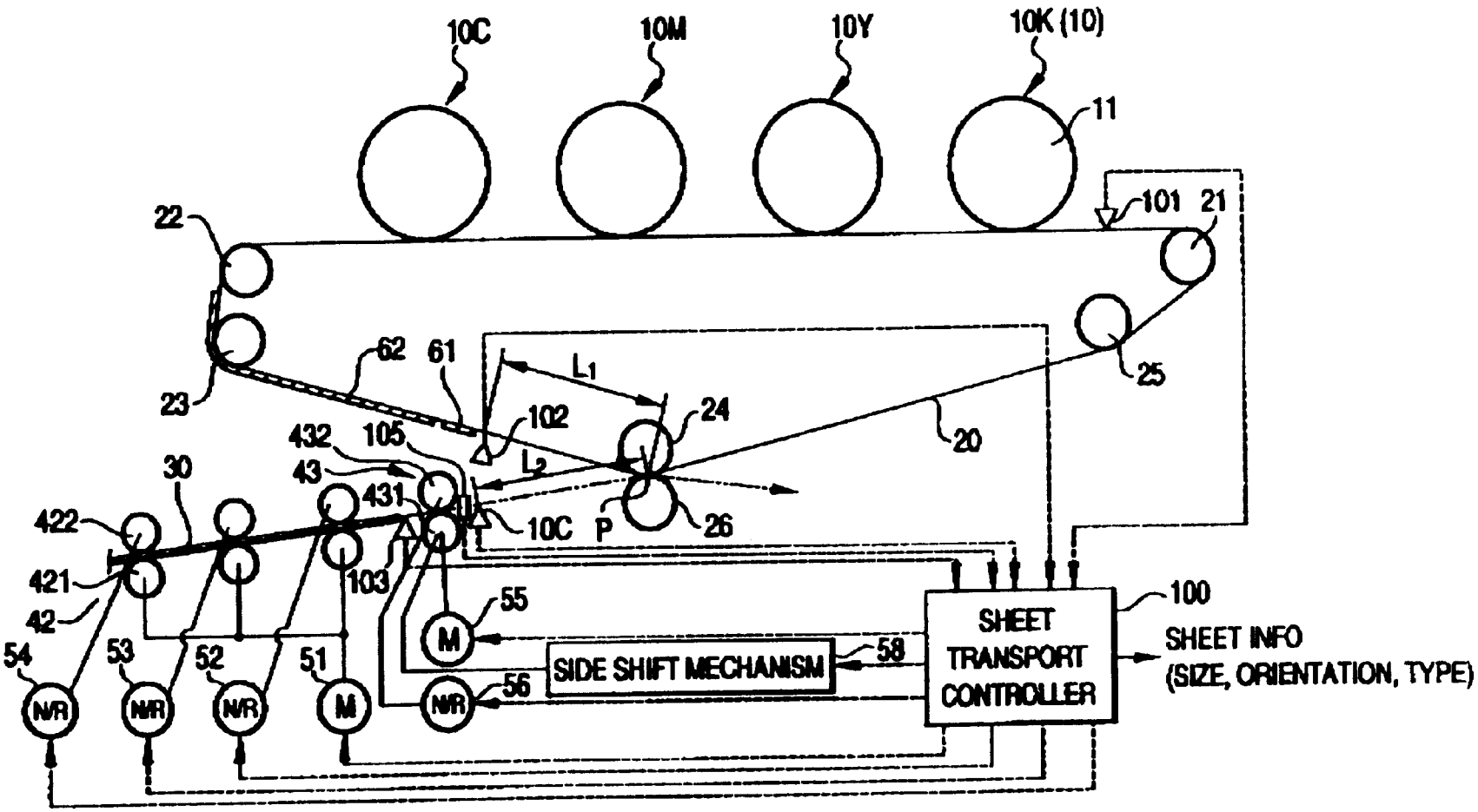
FIG. 4 is a detailed explanatory diagram showing a sheet transport device according to the first embodiment.

In the image-forming apparatus of the present embodiment, operation for conveying the sheet 30 is controlled by a sheet transport control system shown in FIG. 4.

A sheet transport speed control method used in the embodiment makes it possible to feed the sheet 30 without stopping it midway in a sheet path. Specifically, the sheet 30 fed from one of the sheet trays 331 or from the manual feed tray is conveyed at a high speed (e.g., 300 mm/second) up to a particularly deceleration point immediately upstream of the secondary image transfer part P. The sheet 30 is decelerated at the deceleration point to a lower process speed (e.g., 150 mm/second) and advanced to the secondary image transfer part P at this low speed.

Referring to FIG. 4, the sheet transport control system includes a sheet transport controller 100 incorporating a microcomputer, an image-forming start sensor 101 provided upstream of the image-forming module 10K which is located most upstream of all the image-forming modules 10 along the intermediate image transfer belt 20, a mark sensor 102 provided upstream of the secondary image transfer part P, a registration inlet sensor 103 provided close to the sheet path immediately upstream of the registration roller pair 43 (registration rollers 431, 432), a registration outlet sensor 104 provided immediately downstream of the registration roller pair 43, and a side shift sensor 105 also provided immediately downstream of the registration roller pair 43 for detecting a side-shifted position of the sheet 30. Given this configuration, the sheet transport controller 100 takes in sensing signals from the individual sensors 101–105 as well as various pieces of information (including the size, orientation and type of the sheet 30 in this embodiment), and performs a leading edge alignment operation and a sheet alignment operation shown in FIGS. 9 and 10, respectively, for example, wherein the sheet transport controller 100 transmits control signals to relevant control elements, such as the motors 51–56 and the side shift mechanism 58.

The sensor 101–105 used in the image-forming apparatus are reflection-type optical sensors, for example. The image-forming start sensor 101 and the mark sensor 102 detect a reference mark 61 on the intermediate image transfer belt 20 and recognize the location of an image 62 which is situated at a specific position relative to the reference mark 61. The reference mark 61 may be a toner patch formed by the image-forming modules 10 on the intermediate image transfer belt 20 for image alignment, or a light reflector or a light-transmitting hole provided for image alignment on the intermediate image transfer belt 20.

The registration inlet sensor 103 and the registration outlet sensor 104 detect whether the leading edge of the sheet 30 has passed points immediately upstream and downstream of the registration roller pair 43, respectively. Also, the side shift sensor 105 detects whether the side edge of the sheet 30 has gone out of the side shift sensor 105.

Since it is necessary to recognize when the image 62 on the intermediate image transfer belt 20 will arrive at the secondary image transfer part P in advance to properly control the transport speed of the sheet 30 in this embodiment, the mark sensor 102 and the registration outlet sensor 104 are positioned such that they respectively detect the reference mark 61 and the leading edge of the sheet 30 in this order. Specifically, the distance L1 between a sensing position of the mark sensor 102 and the secondary image transfer part P is made similar than the distance L2 between a sensing position of the registration outlet sensor 104 and the secondary image transfer part P.

Operation of the image-forming apparatus of the present embodiment is now described with reference to FIGS. 4, 9 and 10, focusing on the working of the sheet transport device 40.

Figure 9:
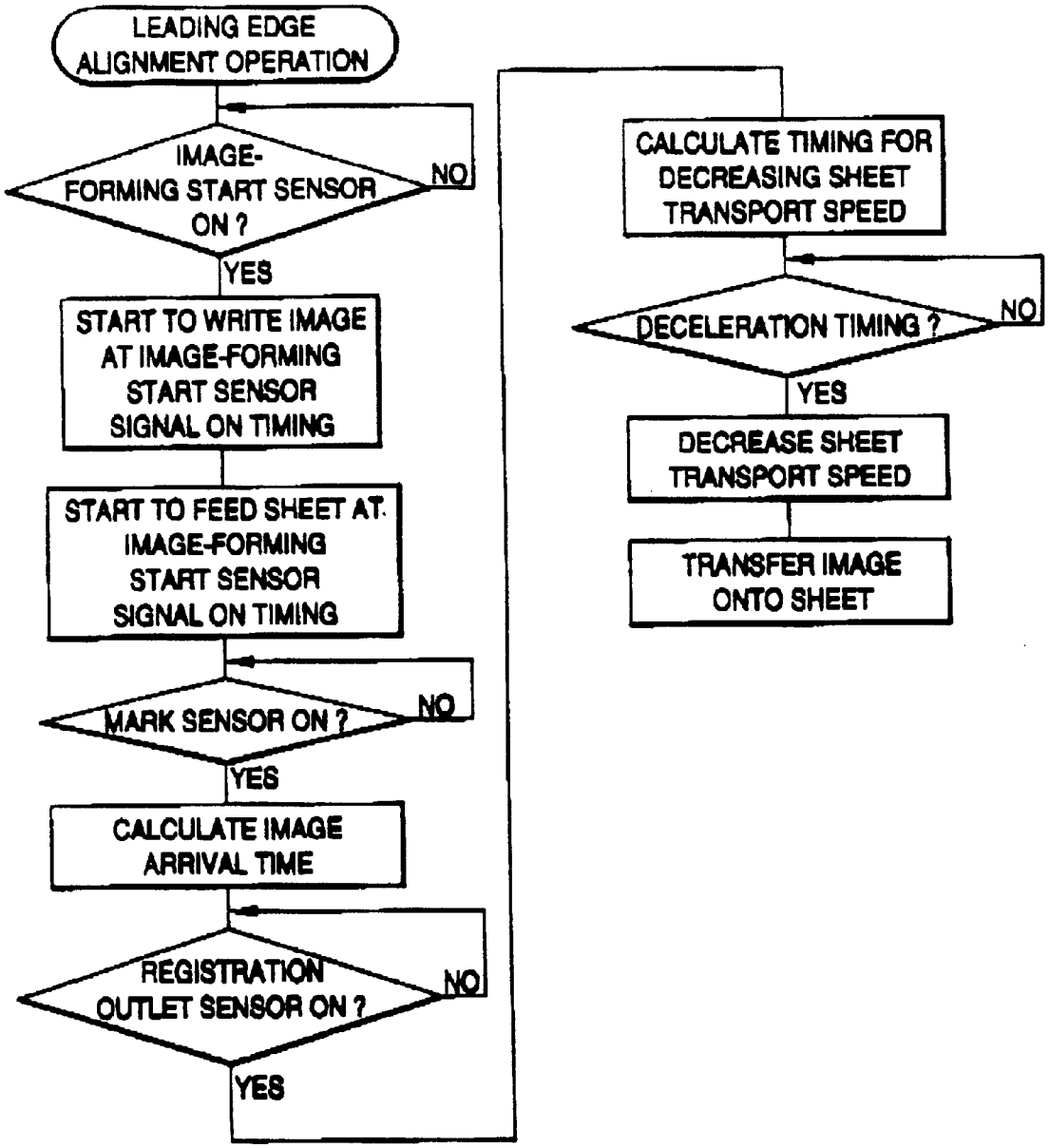
FIG. 9 is a flowchart showing a leading edge alignment routine performed in the first embodiment as part of a sheet transport control operation.

First, the leading edge alignment operation shown in FIG. 9 for aligning the leading edge of the sheet 30 is described.

When an image-forming start command has been given, the sheet transport controller 100 repeatedly checks whether the image-forming start sensor 101 has turned on. When the image-forming start sensor 101 detects the reference mark 61 on the intermediate image transfer belt 20 and becomes on, the individual image-forming modules 10 (10K, 10Y, 10M, 10C) are set to work at this sensor-on timing (reference mark detection timing) and write toner images on the intermediate image transfer belt 20. The toner image of individual color components written by the individual image-forming modules 10 are overlaid one on top of another, eventually forming a combined toner image 62 which is located at the exact position relative to the reference mark 61.

Then, the sheet transport controller 100 repeatedly checks whether the mark sensor 102 has turned on. When the mark sensor 102 detects the reference mark 61 on the intermediate image transfer belt 20 and becomes on, the sheet transport controller 100 begins at this sensor-on timing (reference patch detection timing) to calculate time when the image 62 on the intermediate image transfer belt 20 arrives at the secondary image transfer part P where the secondary image transfer roller 26 and the backup roller 24 are pressed against each other.

The time when the image 62 arrives at the secondary image transfer part P may be calculated using the distance L1 between the mark sensor 102 and the secondary image transfer part P and the running speed of the intermediate image transfer belt 20.

The running speed of the intermediate image transfer belt 20 can be exactly calculated from the rotational period of the intermediate image transfer belt 20, or the time required for the image-forming start sensor 101 to turn on since it turned on previously, and the length of the intermediate image transfer belt 20. Preferably, the distance L1 between the mark sensor 102 and the secondary image transfer part P is made equal to integer multiples of the circumference of the driving roller 21, because potential errors due to misalignment of the driving roller 21 could be reduced.

Referring to FIGS. 3 and 4, when the image-forming start sensor 101 turns on, a sheet 30 is fed from one of the sheet trays 331 or from the manual feed tray based on the sensor-on timing. Then, the sheet 30 is advanced downstream along the sheet path through the transport roller pairs 41, the slantwise transport roller pairs 42 and the registration roller pair 43 (registration rollers 431, 432) in this order.

While the sheet 30 is being advanced, the sheet transport controller 100 repeatedly checks whether the registration outlet sensor 104 has turned on. When the registration outlet sensor 104 detects the leading edge of the sheet 130 which has passed through the registration roller pair 43, the registration outlet sensor 104 becomes on. Then, the sheet transport controller 100 begins at this sensor-on timing (sheet passage direction timing) to calculate deceleration timing at which the transport speed of the sheet 30 is decreased. Although the transport speed is changed from the high speed to the low speed (process speed) with particular deceleration timing in this embodiment, the invention is not limited thereto. Alternatively, the sheet transport controller 100 may calculate an appropriate deceleration pattern. For example, the transport speed of the sheet 30 may be changed in multiple steps from the high speed to the low speed, the transport speed may be once decreased to a speed lower than the predefined low speed and then increased to the low speed.

Figure 15A:
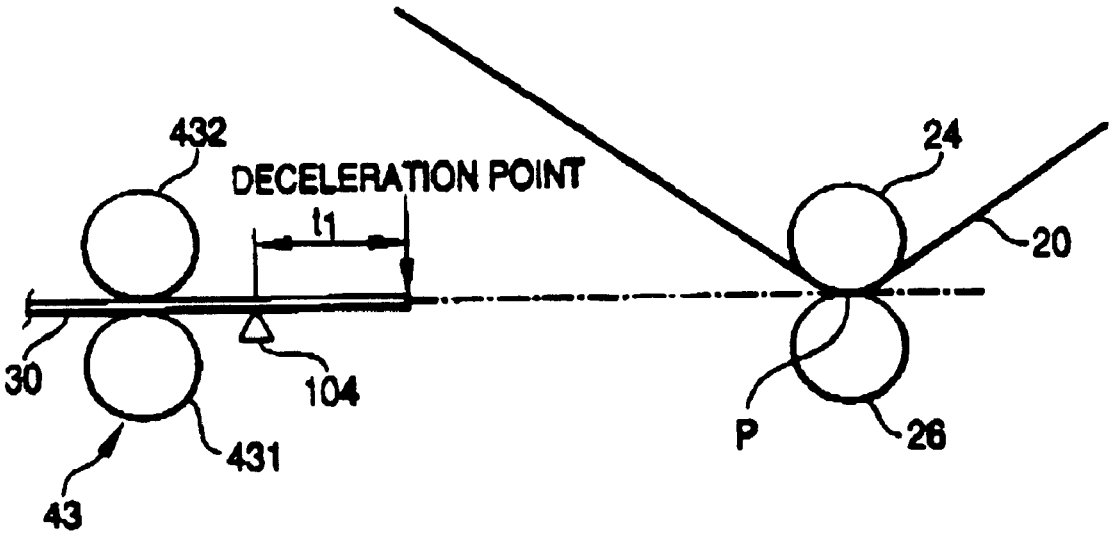
FIG. 15A is an explanatory diagram showing a sheet deceleration operation performed before the sheet arrives at a secondary image transfer part.

Then, the sheet transport controller 100 repeatedly checks whether the deceleration timing calculated as described above has been reached, as depicted in FIG. 15A, for instance. When the deceleration timing has been reached, or when a time period t1 has elapsed since the leading edge has passed over the registration outlet sensor 104 as shown in FIG. 15A, for instance, the transport speed of the sheet 30 is reduced from the high speed to the low speed (process speed).

When the sheet 30 has arrived at the secondary image transfer part P, the toner image 62 formed on the intermediate image transfer belt 20 is transferred onto the sheet 30 exactly at its specified position.

The image-forming apparatus of the embodiment performs the sheet alignment operation (FIG. 10) to align the side edge of the sheet 30, in addition to the above-described leading edge alignment operation (FIG. 9).

Figure 10:
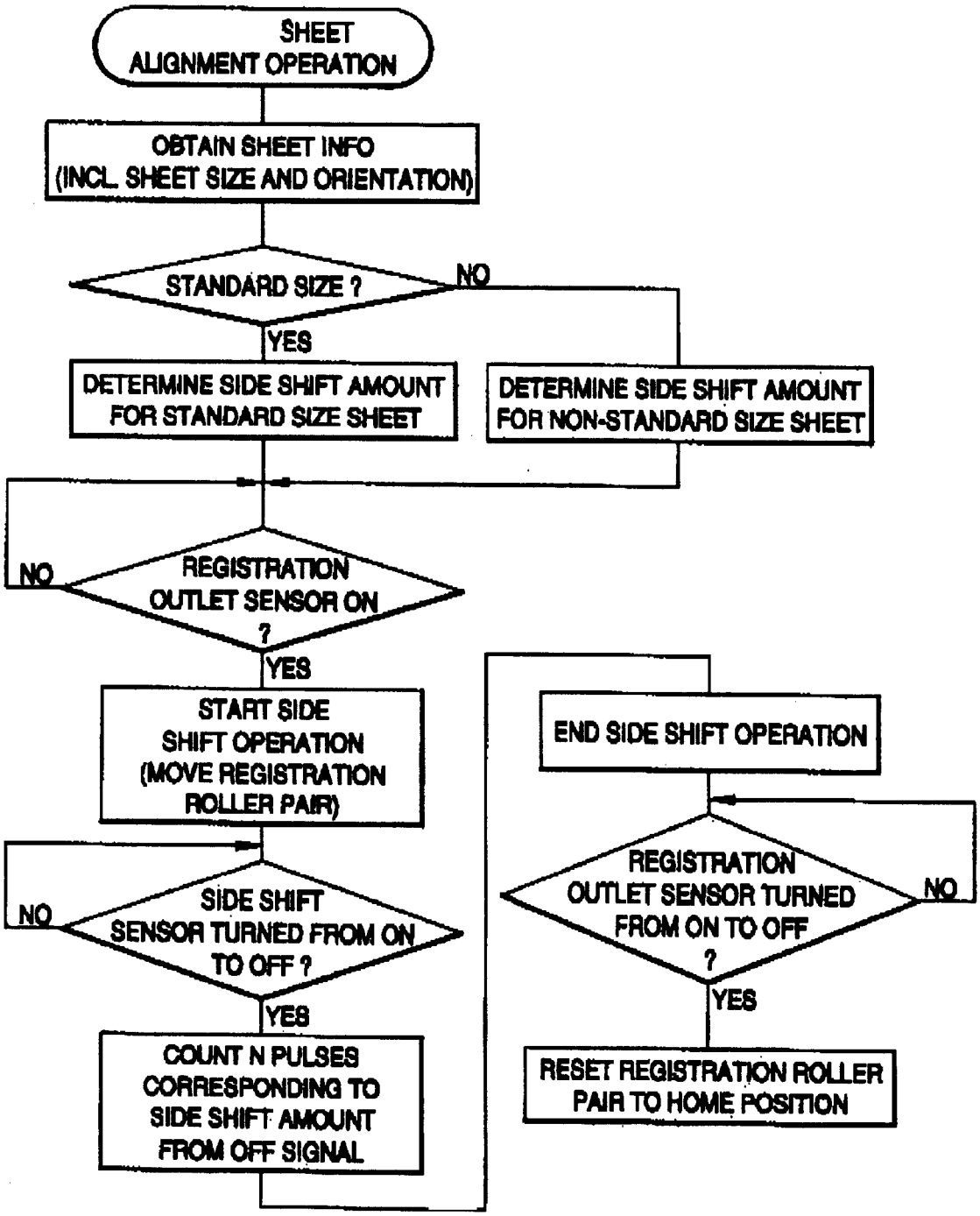
FIG. 10 is a flowchart showing a sheet alignment routine performed in the first embodiment as another part of the sheet transport control operation.

Referring to FIG. 10, the sheet transport controller 100 first obtains information on the sheet 30 which is now to be transported. This sheet information includes the size and orientation of the sheet 30. Upon obtaining the sheet information, the sheet transport controller 100 makes a judgment to determine whether the sheet 30 is of a standard size or not. If the sheet 30 is of a standard size, the sheet transport controller 100 determines a side shift amount for the relevant standard size sheet. Contrary to this, if the sheet 30 is of a non-standard size, the sheet transport controller 100 determines a side shift amount for the relevant non-standard size sheet.

According to a method of determining the side shift amount for standard and non-standard size sheets employed in this embodiment, for example, a reference position for each set of sheet information (size and orientation) is stored in a memory and the sheet transport controller 100 selects the reference position corresponding to the sheet information obtained.

Specifically, the sheet transport controller 100 makes a judgment to determine whether the sheet 30 is of a standard A3 or smaller JIS size, a 12-inch standard size or a 12.6-inch standard size when the sheet 30 is a standard size sheet. Then, the sheet transport controller 100 selects an appropriate side shift amount (a1, a2 or a3) relative to the initial side alignment position of SIP from the following table.

| Sheet Size | Side Shift Amount |
|---|---|
| A3 or smaller standard size | a1 = 16.52 mm in this embodiment |
| 12-inch standard size | a2 = 12.62 mm in this embodiment |
| 12.6-inch standard size | a3 = 5 mm in this embodiment |

Each of these side shift amounts a1–a3 is achieved by entering a corresponding number of drive pulses (A pulses, B pulses or C pulses) into the side shift motor 584 of the side shift mechanism 58 after the sheet 30 has passed the side shift sensor 105.

On the other hand, when the sheet 30 is a non-standard size sheet (X mm), the sheet transport controller 100 makes a judgment to determine whether it is equivalent to or smaller or larger than the standard A3 size, and selects an appropriate side shift amount (a1 or a4) from the following table.

| Sheet Size | Side Shift Amount |
|---|---|
| Non-standard size equivalent to or smaller than A3 | a1 = 16.52 mm in this embodiment |
| Non-standard size larger than A3 | a4 = (12.6 inches · 25.4 mm − X mm) + 2–5 mm in this embodiment |

Each of these side shift amounts a1, a4 is also achieved by entering a corresponding number of drive pulses (A pulses or D pulses) into the side shift motor 584 of the side shift mechanism 58 after the sheet 30 has passed the side shift sensor 105.

In this embodiment, either a3 or a4 is made larger than the distance b between the initial side alignment position SIP and the side edge of the intermediate image transfer belt 20, so that the entire width of the sheet 30 is nipped between the intermediate image transfer belt 20 and the secondary image transfer roller 26 even when the width of the sheet 30 is larger than the width of the maximum image area Gmax.

While determining the side shift amount for the sheet 30 as described above, the sheet transport controller 100 feeds the sheet 30 from one of the sheet trays 331 or from the manual feed tray.

Figures 11A, 11B, 11C, 11D:
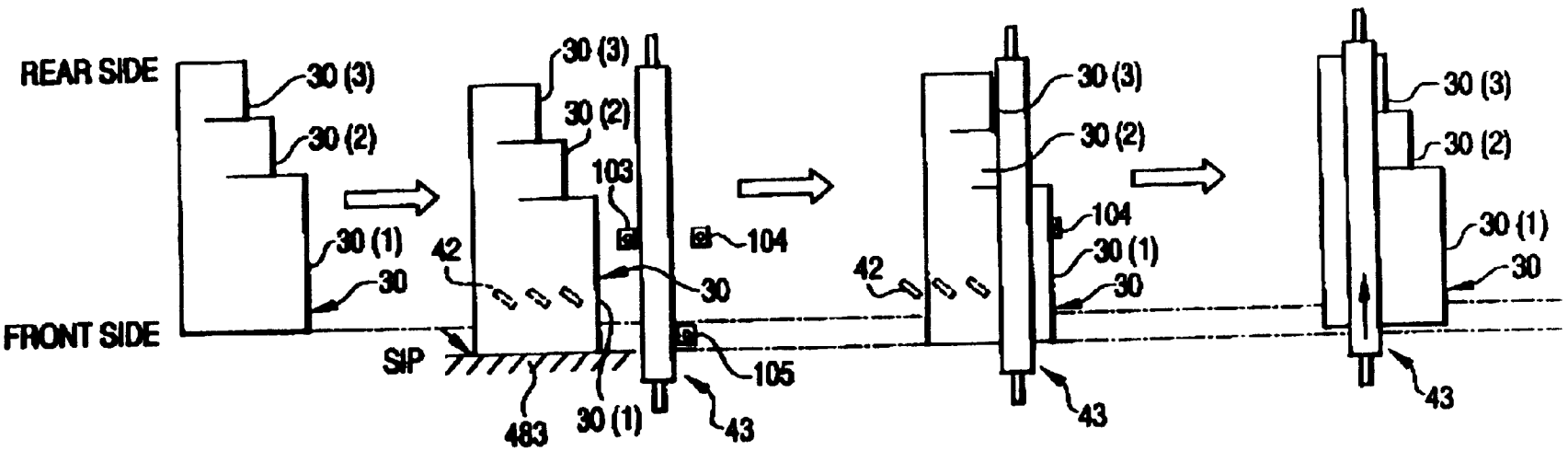
FIGS. 11A–11D are explanatory diagrams showing successive steps of a sheet transport process according to the first embodiment.

When the sheet 30 is from one of the sheet trays 331 or from the manual feed tray, the sheet 30 is initially aligned with a front side reference position of the relevant tray as shown in FIGS. 3 and 11A. At this initial stage, however, the side edge of the sheet 30 is aligned with only low accuracy. FIGS. 11A–11D and 12A–12C schematically illustrate successive steps of a sheet transport process for three different types of sheets 30 (30(1), 30(2) and 30(3)) whose sizes would be the A3 or smaller standard size (e.g., A3, B4, A4), the 12-inch standard size and the 12.6-inch standard size, for example.

When the sheet 30 which has passed through the transport roller pairs 41 arrives at the location of the slantwise transport roller pairs 42, the sheet 30 is moved obliquely toward the fixed side guide 483 by the slantwise transport roller pairs 42 and advanced toward the registration roller pair 43 with the side edge of the sheet 30 aligned with the initial side alignment positions SIP as shown in FIGS. 3 and 11B. Thus, even when the sheet 30 is skewed, or positioned at a slant, in the sheet transport process, a skew correction operation properly aligns the sheet 30 parallel to its transport direction.

Figure 13A:
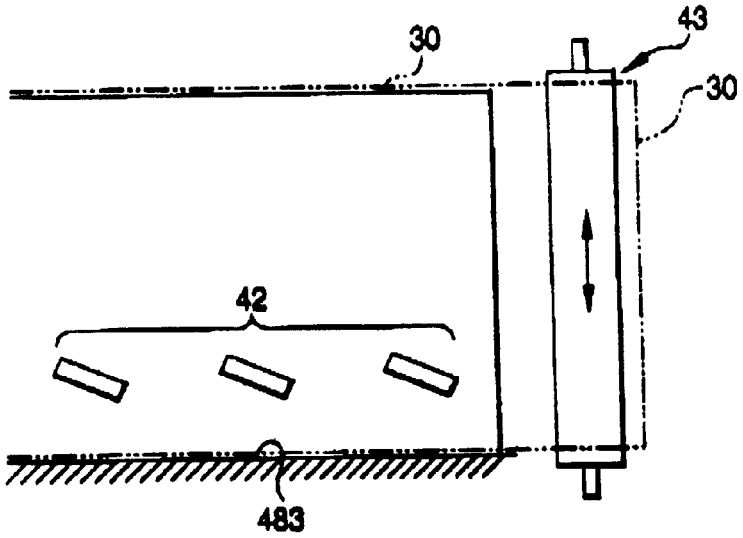
FIG. 13A is an explanatory diagram showing how a sheet is transported from a position shown in FIG. 11B to a position shown in FIG. 11C.
Figure 13B:
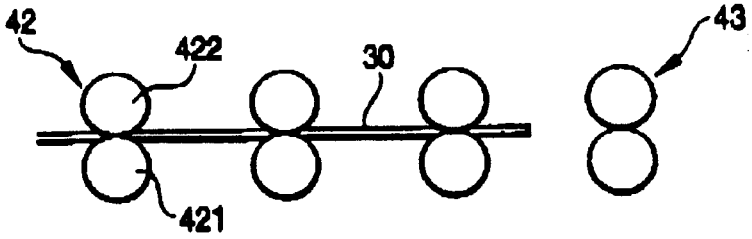
FIG. 13B is an explanatory diagram showing the status of individual rollers of the sheet transport unit when the sheet is located at a position shown by solid lines in FIG. 13A.
Figure 13C:
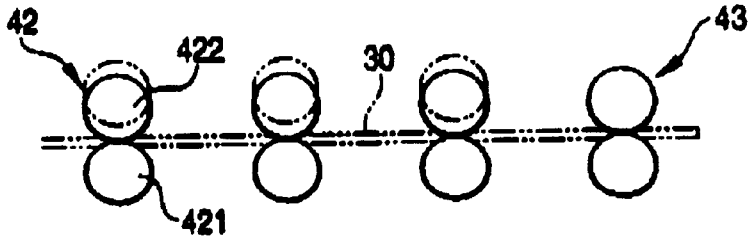
FIG. 13C is an explanatory diagram showing the status of the individual rollers of the sheet transport unit when the sheet is located at a position shown by alternate long and two short dashed lines in FIG. 13A.

Although the individual slantwise transport roller pairs 42 continue to nip the sheet 30 before it reaches the registration roller pair 43 as shown by solid lines in FIGS. 13A and 13B, the slantwise transport roller pairs 42 release the sheet 30 when it goes into the registration roller pair 43 as shown by imaginary lines in FIGS. 13A and 13C.

In this embodiment, the nip/release motors 52–54 relieve the slantwise transport roller pairs 42 of their nip positions when a predetermined time period (which would be sufficient for the leading edge of the sheet 30 to be nipped by the registration roller pair 43) has elapsed since the leading edge of the sheet 30 has passed over the registration inlet sensor 103 as shown in FIGS. 11B and 11C.

When the leading edge of the sheet 30 arrives at the registration outlet sensor 104 as shown in FIG. 11C, the registration outlet sensor 104 becomes on and, as a consequence, the sheet transport controller 100 begins a side shift operation to shift the sheet 30 sideways as shown in FIG. 10. Specifically, the side shift mechanism 58 (FIG. 7) moves the registration roller pair 43, in which the sheet 30 is nipped, in the axial direction as shown in FIG. 11D.

Figure 14A:
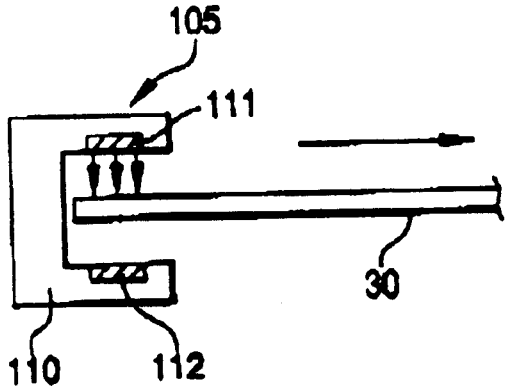
FIGS. 14A–14C are explanatory diagrams schematically showing how the sheet is shifted sideways from a position shown in FIG. 12A to a position shown in FIG. 12B.

The side shift sensor 105 is, for example, a photocoupler having a light emitting element 111 and a light receiving element 112 which are disposed face to face with each other in a channel-like sensor case 110 as shown in FIG. 14A. The side edge of the sheet 30 which has been lined up with the initial side alignment position SIP passed through a gap between the light emitting element 111 and the light receiving element 112.

Figure 14B:
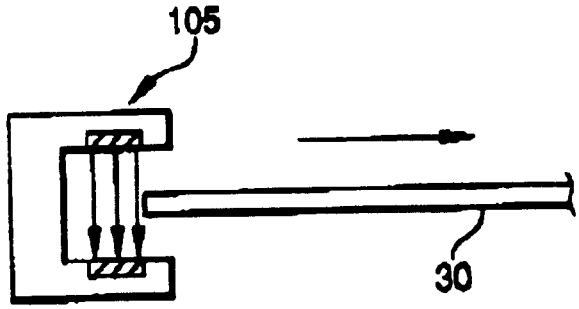

When the sheet 30 nipped by the registration roller pair 43 is moved in its axial direction, the sheet 30 will eventually go out of the gap between the light emitting element 111 and the light receiving element 112 as shown in FIG. 14B and the light receiving element 112 receives the whole of light emitted by the light emitting element 111. At this point (FIG. 12A), the side shift sensor 105 turns from an ON state (in which the light receiving element 112 gives a low level) to an OFF state (in which the light receiving element 112 gives a high level).

Figure 14C:
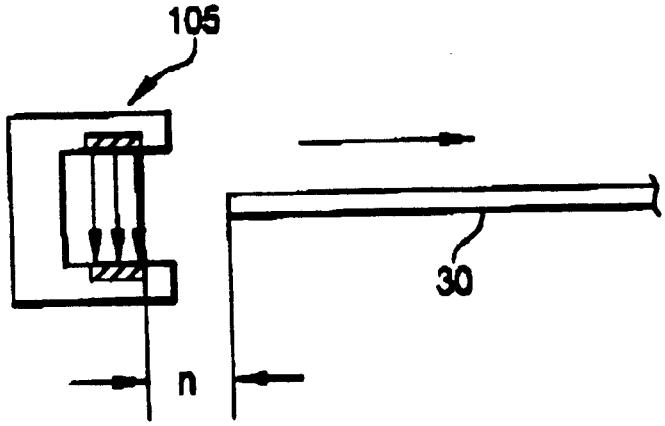

Then, the sheet transport controller 100 counts n pulses corresponding to the side shift amount from an OFF signal received from the side shift sensor 105 as shown in FIG. 10 and shifts the sheet 30 by an amount corresponding to the n pulses as shown in FIG. 14C.

If the sheet 30 is an A3 or smaller standard size sheet 30(1), for instance, the number of pulses n equals A so that the sheet 30(1) is aligned to a reference position which is a1 (16.52 mm) apart from the initial side alignment position SIP. Similarly, if the sheet 30 is a 12-inch standard size sheet 30(2), the number of pulses n equals B so that the sheet 30(2) is aligned to a reference position which is a2 (12.62 mm) apart from the initial side alignment position SIP. Further, if the sheet 30 is a 12.6-inch standard size sheet 30(3), the number of pulses n equals C so that the sheet 30(3) is aligned to a reference position which is a3 (5 mm) apart from the initial side alignment position SIP.

The side shift operation for the sheet 30 is finished at this point, where the sheet transport controller 100 stops to move the registration roller pair 43 in its axial direction and the sheet 30 aligned with the appropriate reference position is advanced by the registration roller pair 43.

A reason why the sheet 30 is aligned by using the side shift sensor 105 in this embodiment is explained below.

The sheet 30 is forced against the fixed side guide 483 by the slantwise transport roller pairs 42 as described above. Thus, if the sheet 30 is a thin sheet of paper, for example, it will flex when it goes into contact with the fixed side guide 483. If the side shift amount is set to a fixed value depending on the size and orientation of the sheet 30 without using the side shift sensor 105, the side shift amount will be seemingly decreased and positioning of the sheet 30 will become inaccurate when it flexes.

Compared to this, it is possible to accurately position the sheet 30 regardless of its type even when it is a thin sheet of paper in the present embodiment, because the sheet 30 is set to the appropriate reference position by monitoring the location of its side edge by the side shift sensor 105 while the sheet 30 is shifted sideways.

Figures 12A, 12B, 12C:
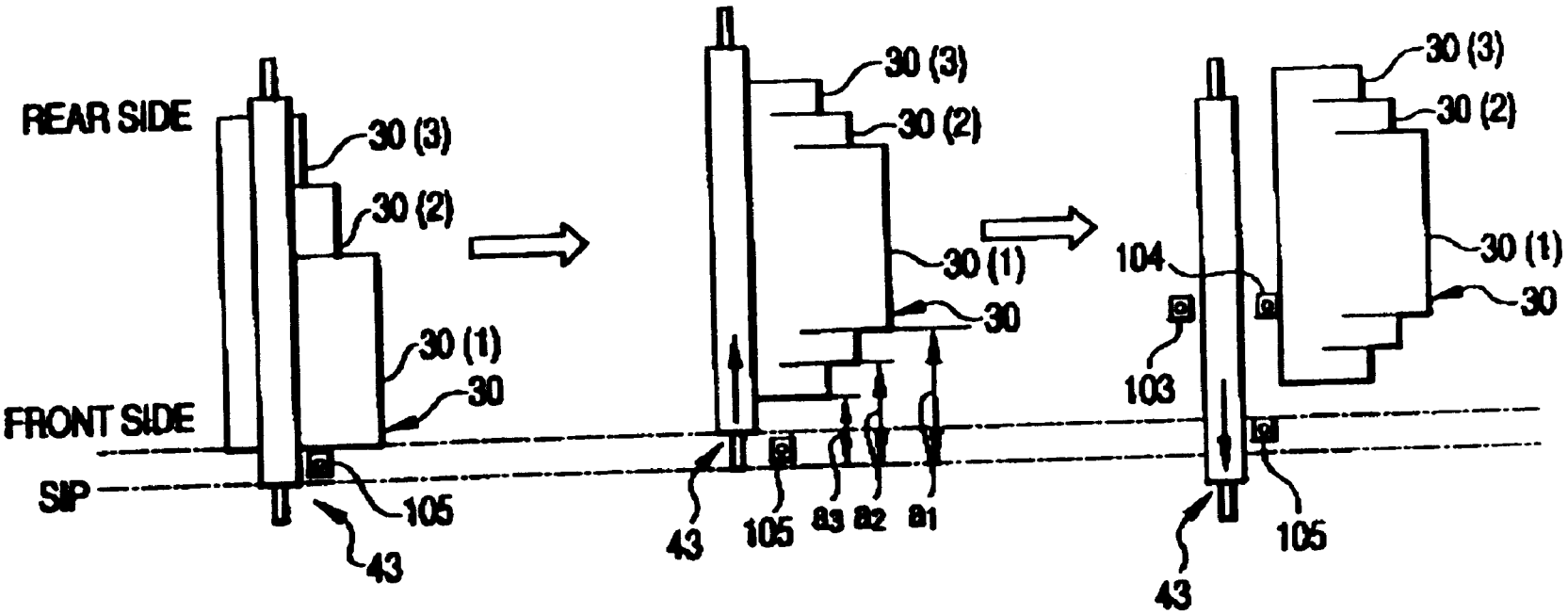
FIGS. 12A–12C are explanatory diagrams showing successive steps of the sheet transport process that follow the steps of FIGS. 11A–11D according to the first embodiment.

When the sheet 30 goes through the registration roller pair 43 and its trailing edge passes over the registration outlet sensor 104 as shown in FIG. 12C, the registration outlet sensor 104 turns from an ON state to an OFF state. At this point, the sheet transport controller 100 causes the side shift mechanism 58 to reset the registration roller pair 43 to its home position as shown in FIG. 10.

Figure 15B:
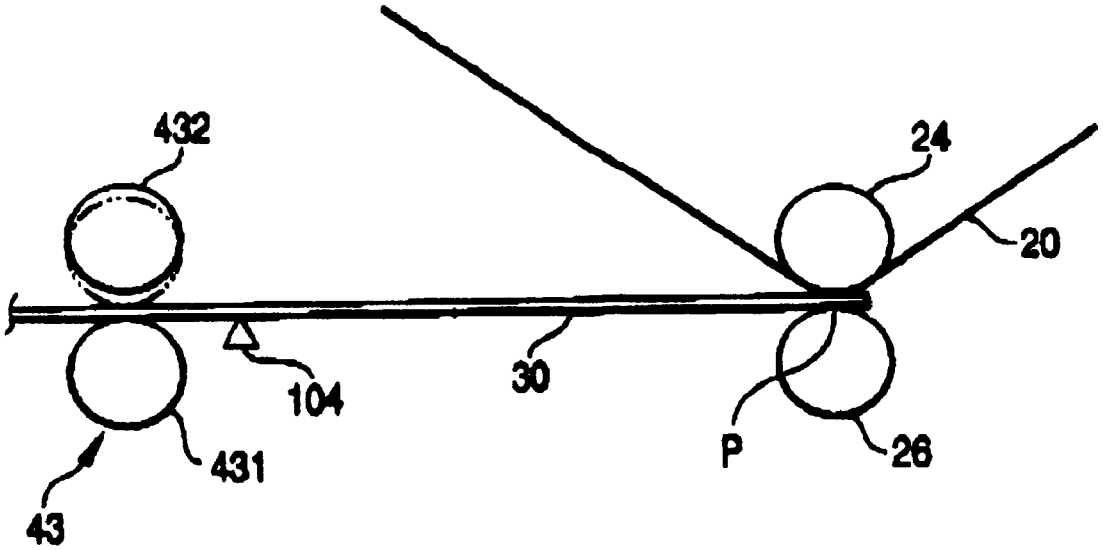
FIG. 15B is a diagram showing a situation when the sheet has just arrived at the secondary image transfer part.

When the leading edge of the sheet 30 arrives at the secondary image transfer part P, the leading edge of the sheet 30 is nipped between the secondary image transfer roller 26 and the backup roller 24 as shown in FIG. 15B. If the trailing edge of the sheet 30 has not passed through the registration roller pair 43 yet at this stage, the nip/release motor 56 (shown in FIG. 4) relieves the registration roller pair 43 of its nip position.

Such a nip/release operation of the registration roller pair 43 is made for reasons explained below.

Firstly, if the registration roller pair 43 is left in its nip position and there is even a small difference in rotating speed between the registration roller pair 43 and the intermediate image transfer belt 20 when the sheet 30 is cardboard, for instance, the image 62 is likely to be incorrectly aligned as it is transferred from the intermediate image transfer belt 20 onto the sheet 30. This is because the intermediate image transfer belt 20 would be pushed forward if the rotating speed of the registration roller pair 43 is relatively higher, or conversely, the intermediate image transfer belt 20 would be pulled backward if the rotating speed of the registration roller pair 43 is relatively lower. The registration roller pair 43 is relieved of its nip position as shown in FIG. 15B to prevent such inconvenience from occurring during image transfer operation. Secondly, it is possible to return the registration roller pair 43 to its home position even when the trailing edge of the sheet 30 has not passed the registration roller pair 43 yet in the above-described method of shifting the registration roller pair 43 sideways. This makes it possible to set an earlier start timing for returning the registration roller pair 43 and, as a consequence, it becomes possible to reduce image intervals in successive image-forming operation and improve productivity.

When it is necessary to feed successive sheets 30 with tightly scheduled timing, or with a little time allowance, a convenient way of handling the sheets 30 would be to relieve the registration roller pair 43 of its nip position and reset the registration roller pair 43 to its home position when the leading edge of one sheet 30 arrives at the secondary image transfer roller 26, and set the registration roller pair 43 to its nip position immediately when the trailing edge of the sheet 30 passes through the registration roller pair 43 so that it can readily nip a succeeding sheet 30.

Figure 16A:
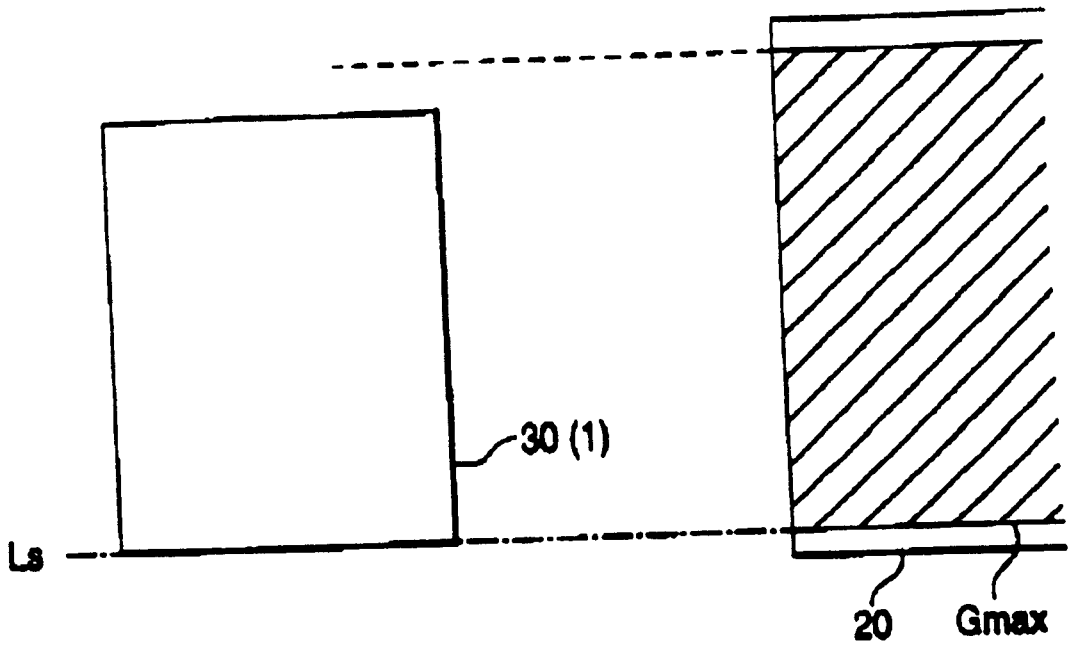
FIG. 16A is a diagram schematically showing a sheet alignment operation performed when the size of the sheet is equal to or smaller than maximum image area.

When the sheet 30 is an A3 or smaller standard size sheet 30(1), for instance, the sheet 30(1) is conveyed to the secondary image transfer part P with its side edge aligned to a side reference position Ls as shown in FIG. 16A in the aforementioned sheet transport process. As a result, the image 62 (which is as large as the A3 size at a maximum) on the intermediate image transfer belt 20 is transferred to an exact position on the sheet 30(1).

Figure 16B:
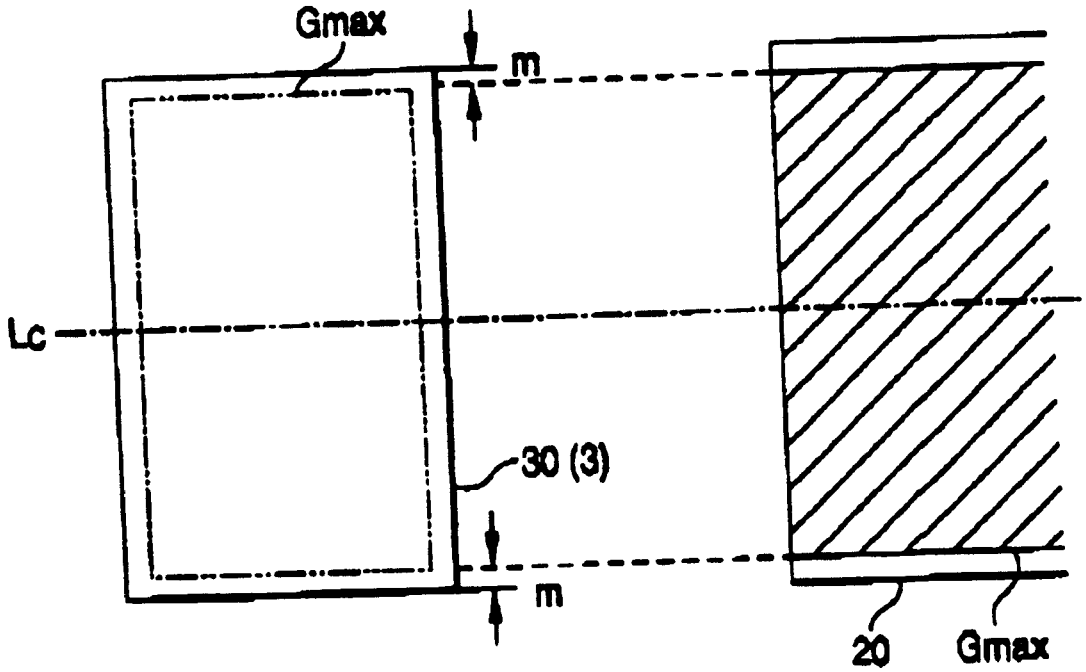
FIG. 16B is a diagram schematically showing a sheet alignment operation performed when the size of the sheet is larger than the maximum image area.

On the other hand, when the sheet 30 is a 12.6-inch standard size sheet 30(3) which is larger than the A3 size, for instance, the sheet 30(3) is conveyed to the secondary image transfer part P with its side edge aligned to a predefined reference position (which is the distance a3 apart from the initial side alignment position SIP) as shown in FIG. 16B.

Aligning the sheet 30(3) as shown in FIG. 16B is equivalent to aligning a center line of its width with a center reference position Lo which is taken at a center line of the width of the intermediate image transfer belt 20. Thus, even when the sheet 30(3) is larger than the maximum image area Gmax, the maximum image area Gmax on the sheet 30(3) is set to a position corresponding to the maximum image area Gmax on the intermediate image transfer belt 20.

Accordingly, the image 62 on the intermediate image transfer belt 20 is transferred exactly within the maximum image area Gmax on the sheet 30(3) excluding its marginal area m.

The center line of the sheet 30 is aligned as described above even when it is a 12-inch standard size sheet 30(2) (FIGS. 12A–12C) or a non-standard size sheet larger than the A3 size.

When the image 62 has been transferred onto the sheet 30 larger than the A3 size leaving its marginal area m blank in the above-described manner, the sheet 30 is passed through the fixing unit 28. Then, the blank marginal area m of the sheet 30 is cut away by the sheet trimmer 324 of the aftertreatment unit 32 a sheet carrying a fixed image which has been trimmed to the standard A3 size is ejected onto the second output tray 323.

If the sheet 30 is of the A3 or smaller standard size, it is passed through the fixing unit 28 and ejected onto the first output tray 321 by the sheet-ejecting assembly 322 of the aftertreatment unit 32 without trimming.

The aforementioned sheet transport device 40 exactly aligns the sheet 30 with the reference position predefined for each set of sheet information in the sheet transport process even when the sheet 30 is not set with so high a positioning accuracy in the sheet tray 331 or the manual feed tray. This makes it possible to achieve a high positioning accuracy as the image 62 is transferred onto the sheet 30.

Furthermore, the sheet 30 is aligned such that the image 62 is transferred to a central part of the sheet 30 when the sheet 30 is larger than the maximum image area Gmax, and the sheet 30 is aligned to the predefined side reference position Ls when its size is equal to or smaller than the maximum image area Gmax in the foregoing embodiment. Therefore, even when multiple sheets 30 of different sizes and/or orientations are handled, alignment of each sheet 30 can be optimized and the image 62 can be transferred to an exact location on each sheet 30. In other words, the image transfer operation can be performed with the sheets 30 of mixed sizes without deterioration in productivity.

SECOND EMBODIMENT

Figure 17A:
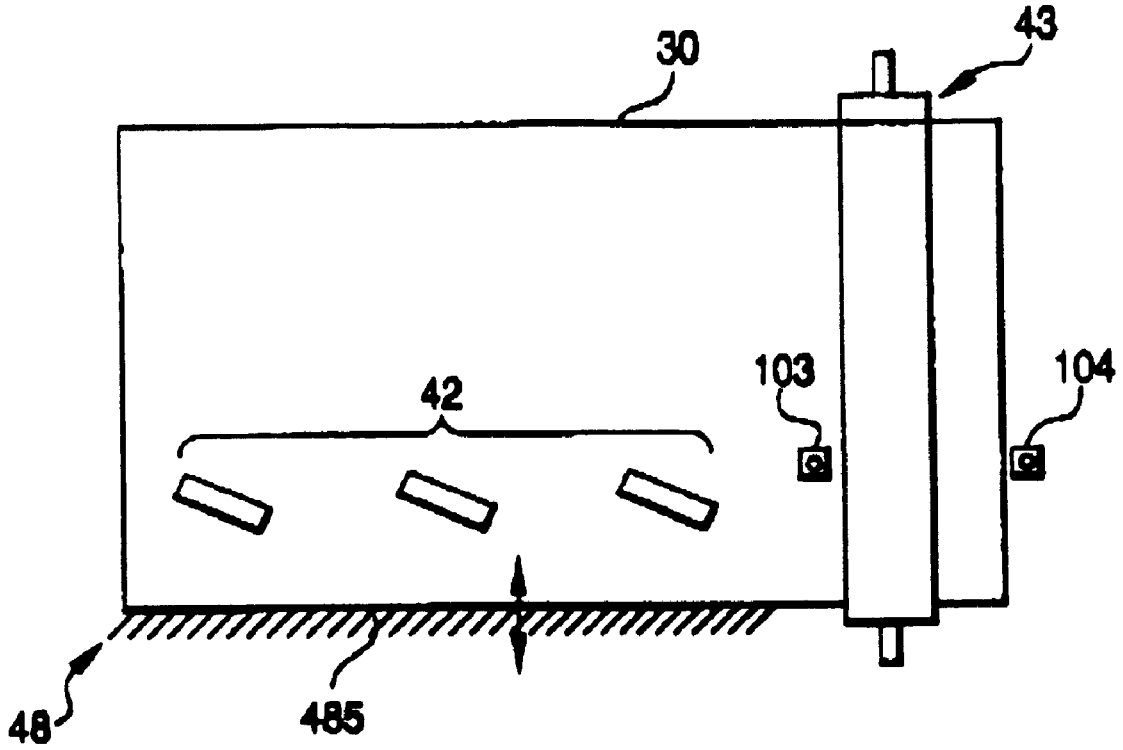
FIGS. 17A and 17B are a plan view and a front view showing principal parts of a sheet transport device used in an image-forming apparatus according to a second embodiment of the invention, respectively.
Figure 17B:
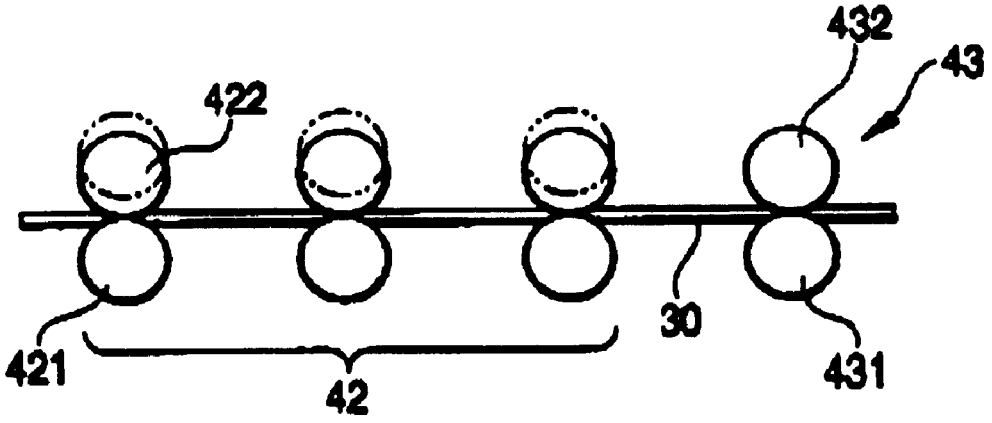
Figure 18A:
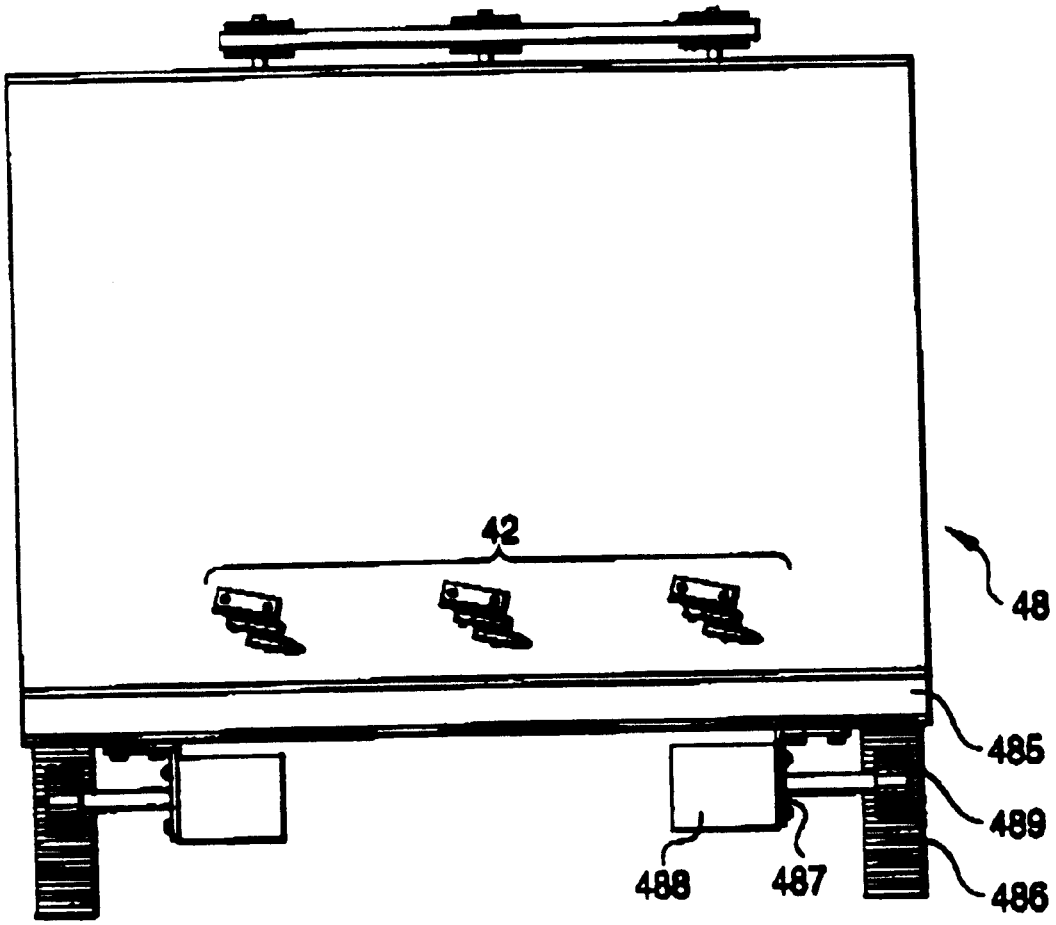
FIGS. 18A and 18B are a plan view and a front view showing a driving mechanism for a movable side guide used in the second embodiment, respectively.
Figure 18B:
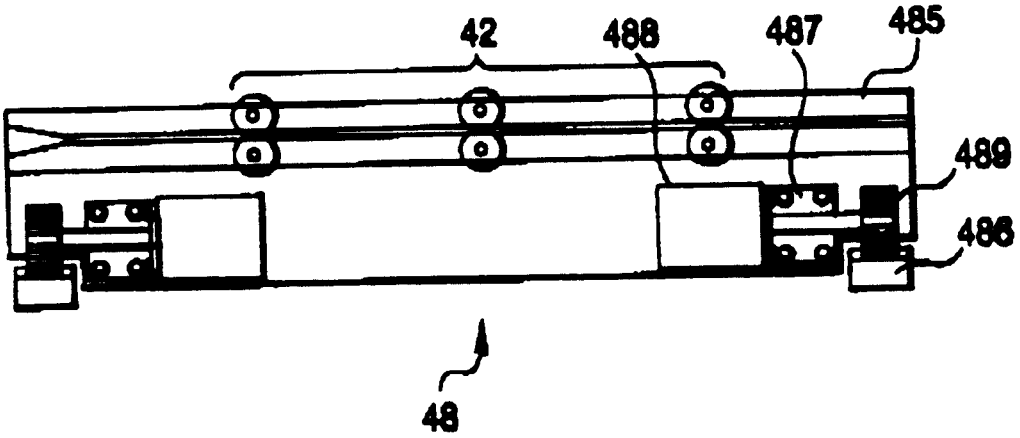

FIGS. 17A and 17B illustrate principal parts of a sheet transport device used in an image-forming apparatus according to a second embodiment of the invention, in which FIG. 17A is a plan view generally showing a sheet transport unit 48 used in the sheet transport device and FIG. 17B is a front view of the same.

The construction of the sheet transport unit 48 of the second embodiment is basically the same as that of the first embodiment, having slantwise transport roller pairs 42, a registration roller pair 43, and so on. Unlike the first embodiment, however, the sheet transport unit 48 of this embodiment has a movable side guide 485 which can move in a direction perpendicular to a transport direction of a sheet 30 depending on each set of sheet information instead of the fixed side guide 483, and the registration roller pair 43 is fixed at a perpendicular position in its axial direction without the provision of the side shift mechanism 58. Constituent elements identical or equivalent to those of the first embodiment are designated by the same reference numerals and a detailed description of such elements is omitted here.

A driving mechanism for the movable side guide 485 of the second embodiment is constructed of a pair of fixed racks 486 extending in the direction in which the movable side guide 485 can move, for instance, a pair of drive motors 488 fixed to the movable side guide 485 by respective brackets 487, and a pair of pinions 489 which are fixed to shafts of the drive motors 488 and engaged with the respective fixed racks 486. The drive motors 488 are caused to turn properly according to the sheet information so that the movable side guide 485 is moved by a specified amount via the pinions 489 and the fixed racks 486.

Figure 19:
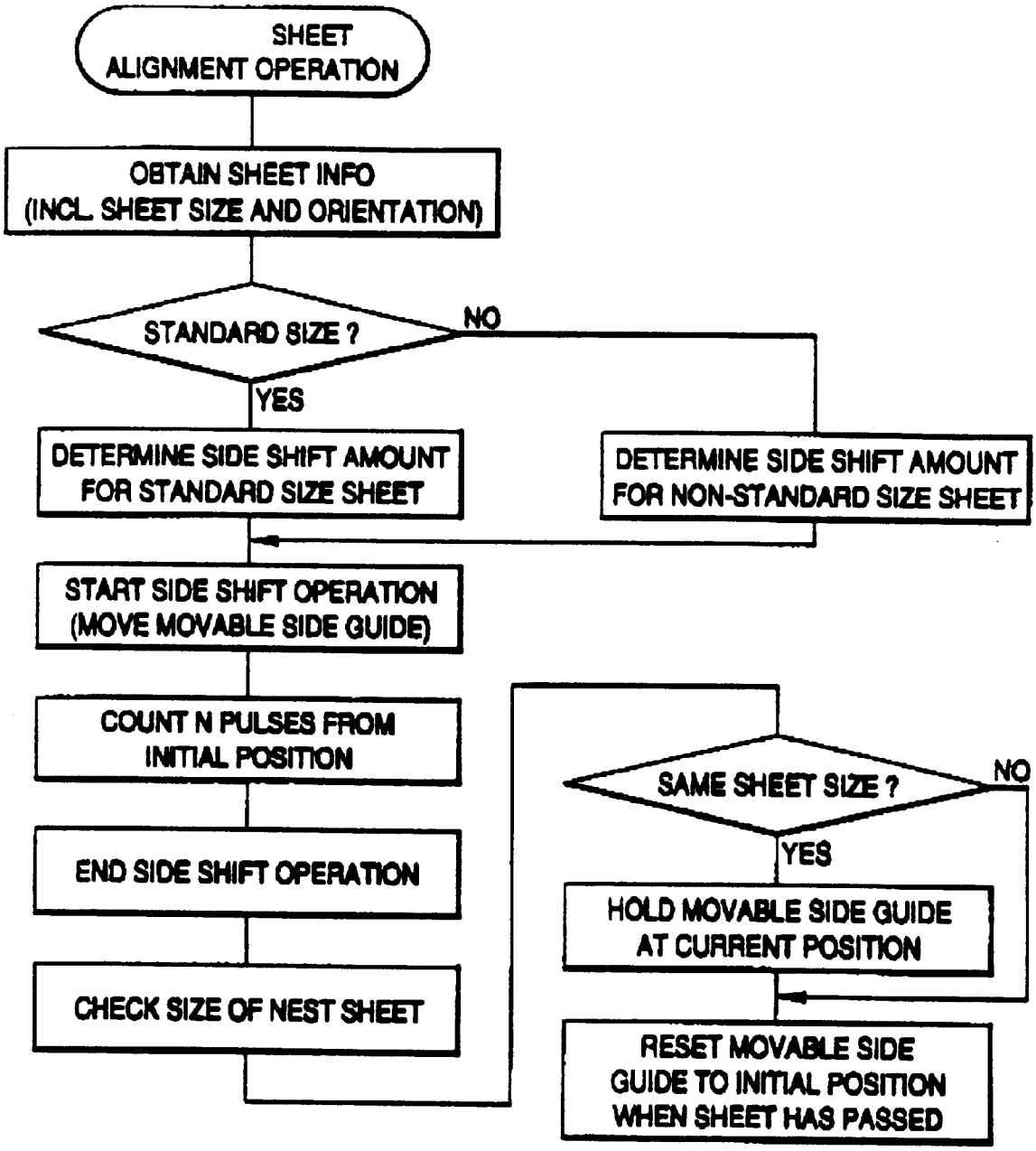
FIG. 19 is a flowchart showing a sheet alignment routine performed in the second embodiment as part of a sheet transport control operation.

Although a sheet transport control system used in this embodiment is constructed generally in the same fashion as the first embodiment, it carries out a sheet alignment operation shown in FIG. 19 which is different from that of the first embodiment (FIG. 10) and transmits control signals to relevant control elements.

The sheet alignment operation according to the second embodiment is now described below. Referring to FIG. 19, a sheet transport controller 100 obtains information on a sheet 30 which is now to be transported including its size and orientation. Then, the sheet transport controller 100 makes a judgment to determine whether the sheet 30 is of a standard size or not. If the sheet 30 is of a standard size, the sheet transport controller 100 determines a side shift amount for the relevant standard size sheet. Contrary to this, if the sheet 30 is of a non-standard size, the sheet transport controller 100 determines a side shift amount for the relevant non-standard size sheet. Here, algorism used for determining each side shift amount is approximately same as the used in the first embodiment.

Subsequently, the sheet transport controller 100 begins to move the movable side guide 485 and counts the number of drive pulses entered to the drive motors 488. When the number of drive pulses counted since the movable side guide 485 was at its initial position has become n corresponding to the side shift amount determined, the sheet transport controller 100 terminates the side shift operation.

At this stage, the movable side guide 485 is set at a reference position appropriate for the sheet information, such as at the distance a1, a2, a3 or a4 apart from the initial side alignment position SIP of the first embodiment, for example. The sheet 30 is conveyed such that it will pass along the relevant reference position at least after the movable side guide 485 has been properly set to the reference position.

The sheet 30 which has been conveyed by a series of transport roller pairs 41 is moved obliquely by the slantwise transport roller pairs 42 toward the movable side guide 485 which has already been set in position. Then, the sheet 30 is advanced with its side edge guided along the reference position defined by the movable side guide 485 and goes into the registration roller pair 43. The sheet 30 is nipped and further advanced by the registration roller pair 43. Subsequently, the sheet 30 is decelerated with specific timing and advanced to a secondary image transfer part F.

On the other hand, the sheet transport controller 100 obtains information on a sheet 30 to be transported next including its size and orientation and checks whether it is of the same size as the current sheet 30. If the size of the next sheet 30 is the same as that of the current sheet 30, the sheet transport controller 100 holds the movable side guide 485 at the current position. If the next sheet 30 is of a different size from the current sheet 30, however, the sheet transport controller 100 resets the movable side guide 485 to its initial position when the current sheet 30 has passed the movable side guide 485.

THIRD EMBODIMENT

Figure 20A:
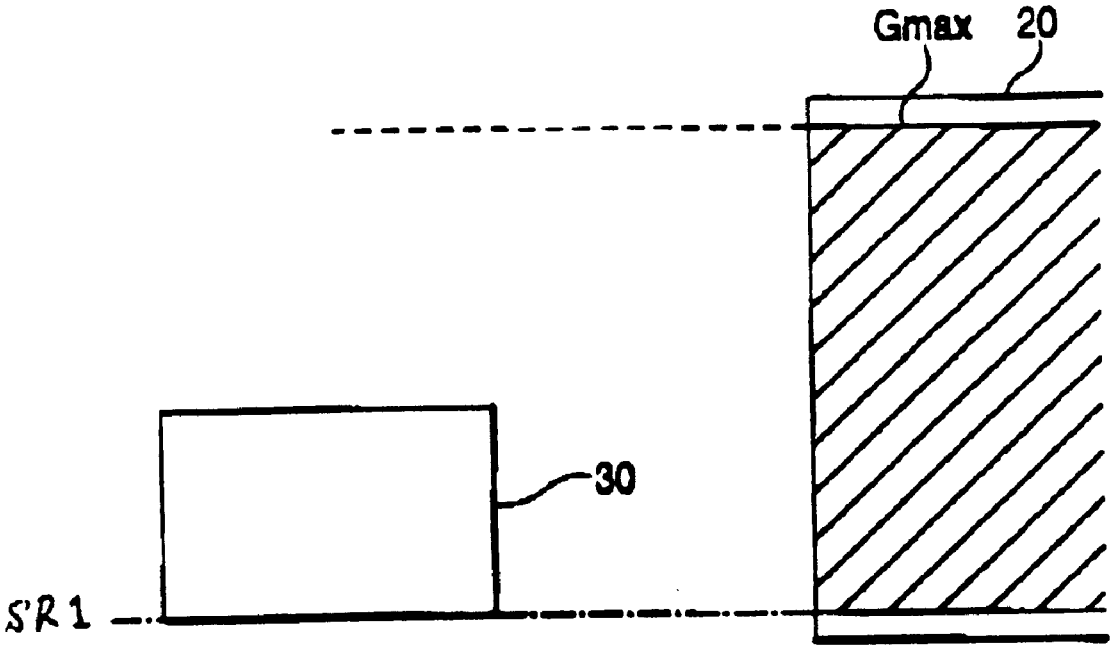
FIGS. 20A and 20B are diagram showing sheet alignment operation processes performed by a sheet transport device used in an image-forming apparatus according to a third embodiment of the invention.
Figure 20B:
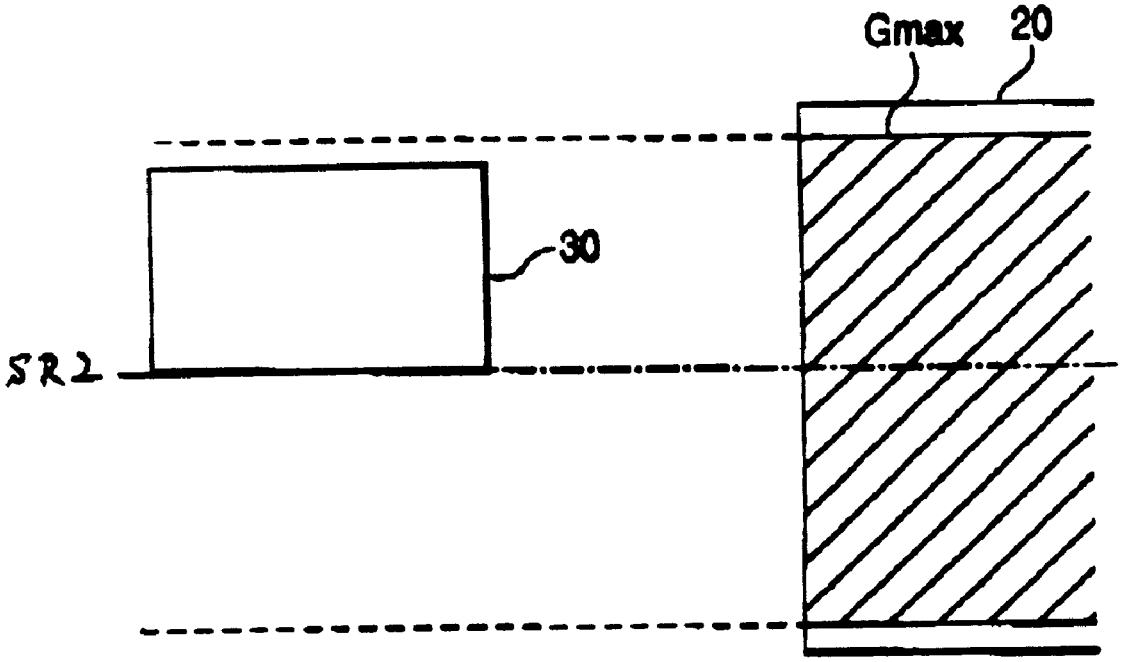

FIGS. 20A and 20B are diagrams showing an operation mode characteristic of a sheet transport device used in an image-forming apparatus according to a third embodiment of the invention.

Although a sheet transport controller 100 of the third embodiment is constructed generally in the same fashion as the first and second embodiments, this sheet transport controller 100 can select a first side reference position SR1 which corresponds to one side boundary of a maximum image area Gmax on an intermediate image transfer belt 20 and a second side reference position SR2 which corresponds to the center line of the width of the maximum image area Gmax under specific conditions when a sheet 30 is of a size equal to or smaller than half the maximum image area Gmax as shown in FIGS. 20A and 20B. This capability of the sheet transport controller 100 makes it possible to uniformly use an entire image-carrying area from the front to the rear of the intermediate image transfer belt 20.

Figure 21:
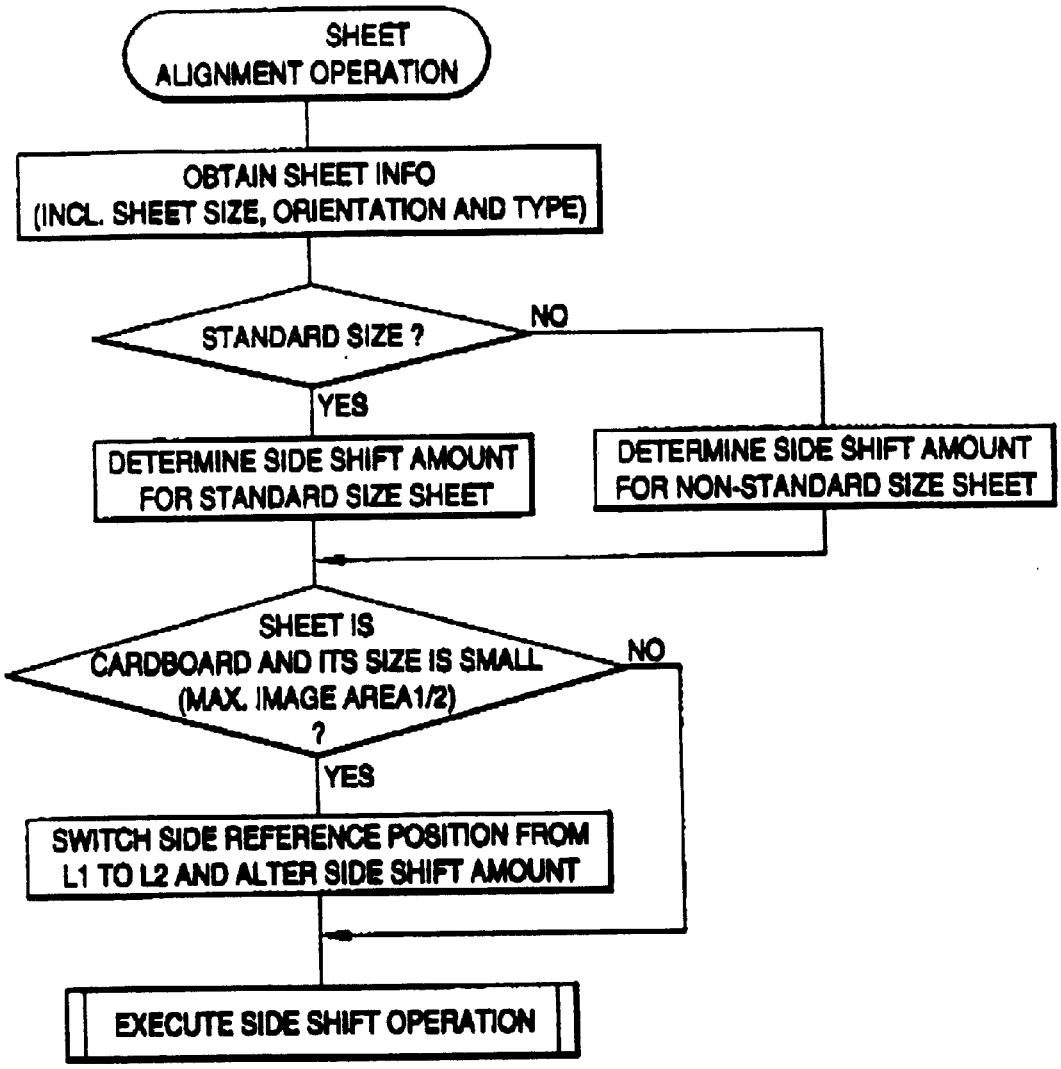
FIG. 21 is a flowchart showing a sheet alignment routine performed in the third embodiment as another part of a sheet transport control operation.

A specific example of such sheet alignment operation is shown in FIG. 21.

Referring to FIG. 21, the sheet transport controller 100 obtains information on a sheet 30 to be transported including not only its size and orientation but also type (e.g., cardboard). Then, the sheet transport controller 100 makes a judgment to determine whether the sheet 30 is of a standard size or not, and determines a side shift amount for the standard size or non-standard size sheet, whichever is appropriate.

Next, the sheet transport controller 100 judges whether the type of the sheet 30 is cardboard and its size is small (equal to or smaller than half the maximum image area Gmax). If the sheet 30 is cardboard and its size is small, the sheet transport controller 100 switches the side reference position from L1 and L2 and alters the side shift amount accordingly.

The sheet transport controller 100 subsequently carries out sequential steps of a side shift operation, such as shifting a registration roller pair 43 or moving a movable side guide 485, for example, to align the sheet 30 to the set side reference position.

In this embodiment, rear portions of the image-carrying areas on the intermediate image transfer belt 20 and on the latent image carrier 11 are used when the sheet 30 is of a small size and cardboard, and front portions of the image-carrying areas on the intermediate image transfer belt 20 and on the latent image carrier 11 are used in other cases. Although cardboard mode might be used less frequently, it is advantageous to uniformly utilize the front and rear portions of the intermediate image transfer belt 20 and the latent image carrier 11 when using small-sized sheets 30, considering that a higher pressure is exerted on the intermediate image transfer belt 20 when it is nipped together with the cardboard, for example. It follows that the aforementioned arrangement of this embodiment serves to lengthen the useful life of the image-forming apparatus.

Compared to this, in an arrangement in which a single predefined side reference position is used for all small-sized sheets 30, the front portions of the image-carrying areas on the intermediate image transfer belt 20 and the latent image carrier 11 will be utilized too frequently while the rear portions of the image-carrying areas are scarcely utilized. This will result in a short useful life of the image-forming apparatus.

Particularly because fixing time in the fixing unit 28 is usually increased in the cardboard mode in which a sheet 30 of cardboard is used, a significant deterioration in productivity does not occur in this embodiment even when the side reference position is switched from L1 and L2 and a large side shift amount is set for the sheet 30.

Although the side reference position is altered when the sheet 30 is of a small size in the cardboard mode in the present embodiment, this arrangement may be modified such that the side reference position is altered when other conditions are met. For example, the side reference position may be altered each time a specified number of small-sized sheets 30 have bee used. Also, side reference positions that can be selected need not necessary be as described above in this embodiment (L1, and L2) but may be otherwise defined and, moreover, there may be defined three or more side reference positions.

FOURTH EMBODIMENT

An image-forming apparatus according to a fourth embodiment of the invention has basically the same construction as that of the aforementioned first, second or third embodiment, whichever is appropriate, but can perform a leading edge alignment operation with greater accuracy.

Specifically, although a sheet transport control system of this embodiment is constructed generally in the same fashion as the first embodiment, it is further provided with an outer diameter measuring unit 130 for measuring the outer diameter of a registration drive roller 431 of a registration roller pair 43. A sheet transport controller 100 takes in sensing signals from individual sensors 101–105 and measurement information from the outer diameter measuring unit 130 and performs an operation shown in FIG. 23, for example, wherein the sheet transport controller 100 transmits control signals to relevant control elements including a drive motor 51.

Figure 22A:
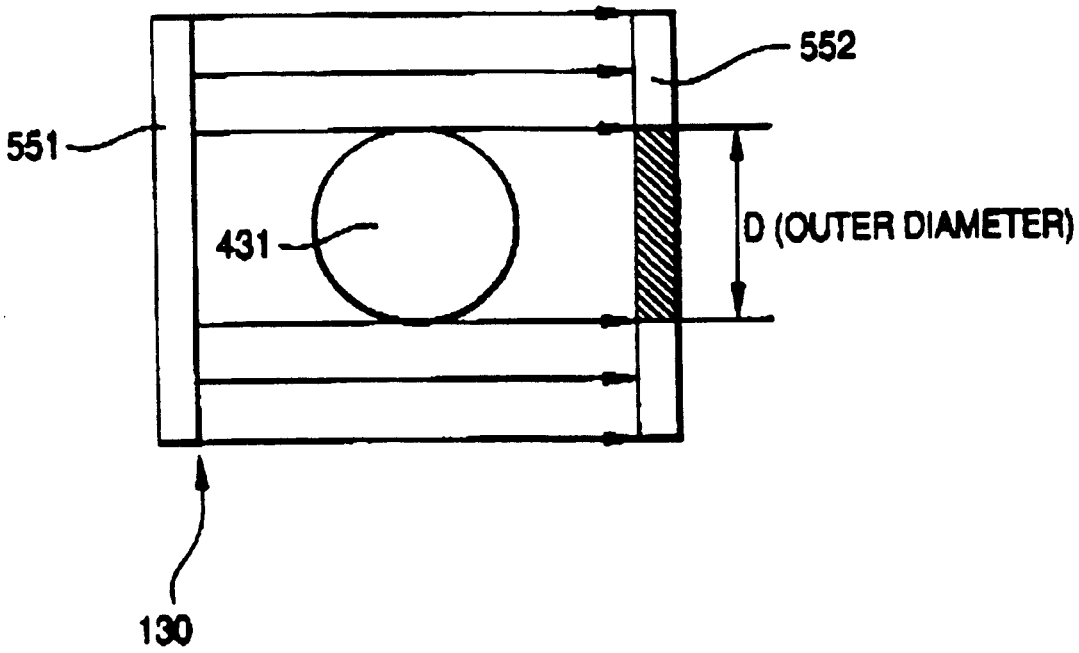
FIG. 22A is a diagram showing an example of an outer diameter measuring unit for measuring the outer parameter of a registration drive roller used in a fourth embodiment of the invention.

FIG. 22A shows a specific example of the outer diameter measuring unit 130, in which a laser light emitting element 551 having a wider light-emitting surface than the outer diameter of the registration drive roller 431 and a laser light receiving element 552 also having a wider light-receiving surface than the outer diameter of the registration drive roller 431 are mounted face to face with each other with the registration drive roller 431 placed in between. With this arrangement, the outer diameter measuring unit 130 determines the outer diameter D of the registration drive roller 431 based on the width of a shadow of the registration drive roller 431 projected onto the laser light receiving element 552 when the laser light emitting element 551 emits laser light toward the registration drive roller 431.

While the outer diameter D of the registration drive roller 431 may be measured basically at its one point, it would be desirable to measure it at several points and average multiple measurements to achieve a higher measuring accuracy.

The arrangement for measuring the outer diameter D of the registration drive roller 431 is not limited to the above-described outer diameter measuring unit 130. For example, it is possible to measure the outer diameter D of the registration drive roller 431 by attaching a pickup to one location on a curved surface of the registration driver roller 431 and measuring a distance from a central axis of the registration drive roller 431 to the pickup.

Figure 23:
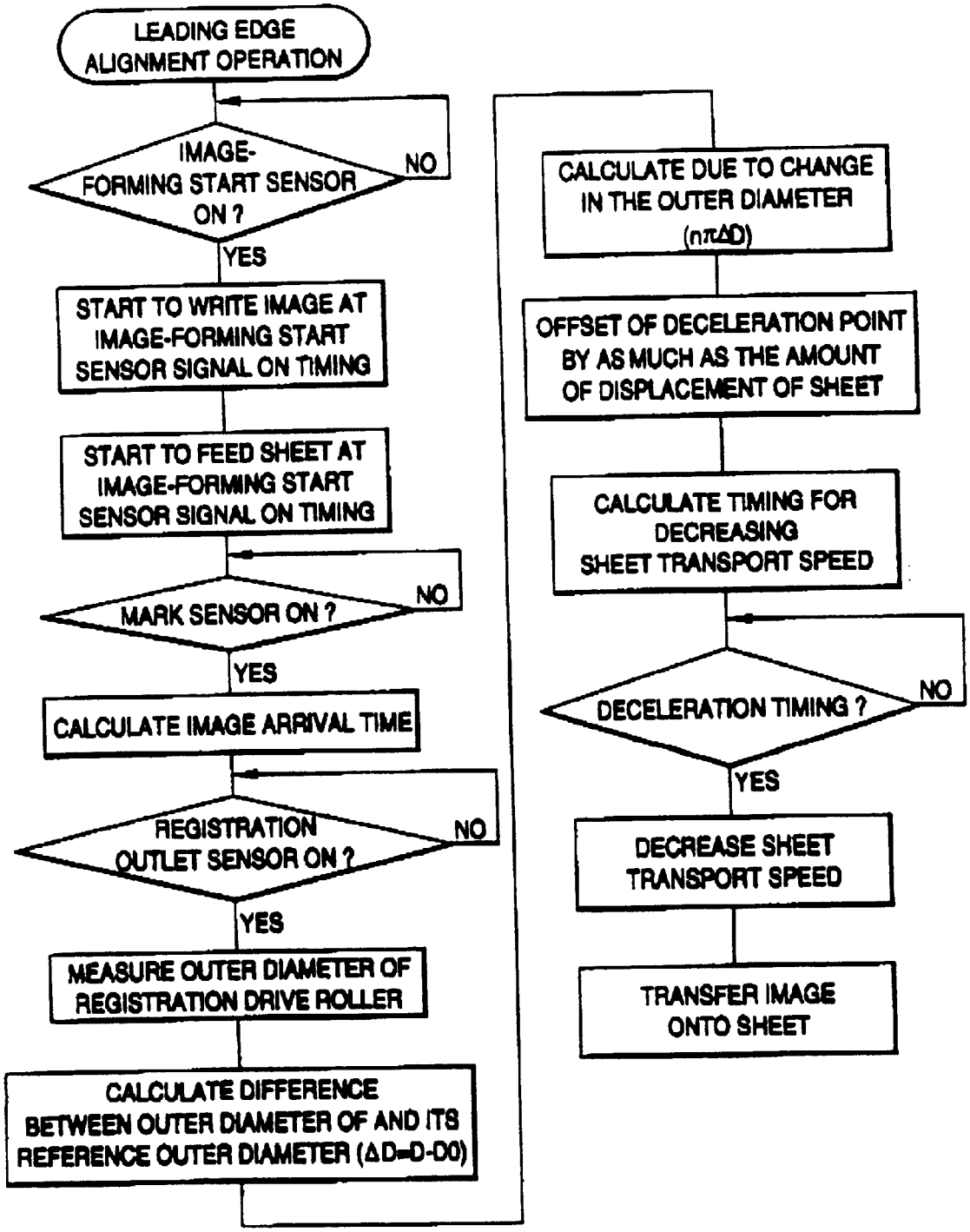
FIG. 23 is a flowchart showing a leading edge alignment routine according to the fourth embodiment.

The leading edge alignment operation according to this embodiment is now described below. Referring to FIG. 23, the sheet transport controller 100 calculates time when an image 62 on an intermediate image transfer belt 20 arrives at a secondary image transfer part P by carrying out sequential steps similar to those of the first embodiment.

What is characteristic of this embodiment is that when the registration outlet sensor 104 becomes on, the outer diameter measuring unit 130 measures the outer diameter of the registration drive roller 431 and data on the outer diameter is entered to the sheet transport controller 100.

When the data on the outer diameter has been entered, the sheet transport controller 100 calculates the difference $\Delta D$ ($=D \cdot D0$) between a reference outer diameter D0 of the registration drive roller 431 (which is predetermined at a reference temperature, for example) and the measured outer diameter D, and further calculates the amount of displacement of a sheet 30 due to a change in the outer diameter of the registration drive roller 431. Provided that the distance L2 between the registration outlet sensor 104 and the secondary image transfer part P is n times the circumference of the registration drive roller 431, the amount of displacement of the sheet 30 is $n\pi\Delta D$ ($=n\pi D - n\pi D0$). Then, the sheet transport controller 100 offsets the deceleration point by as much as the amount of displacement of the sheet 30.

Figure 24A:
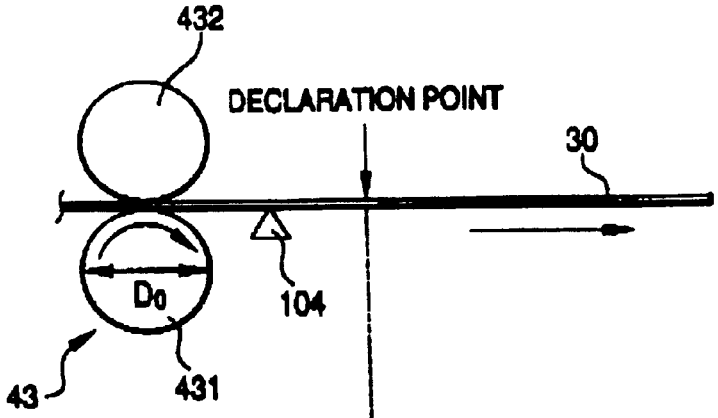
FIG. 24A is a diagram schematically showing a sheet transport control operation performed in the fourth embodiment when there is no change in the outer diameter of the registration drive roller.

For example, if the outer diameter of the registration drive roller 431 is equal to its reference outer diameter D0 as shown in FIG. 24A, there occurs no displacement of the sheet 30 due to a change in the outer diameter of the registration drive roller 431, so that the deceleration point is not varied.

Figure 24B:
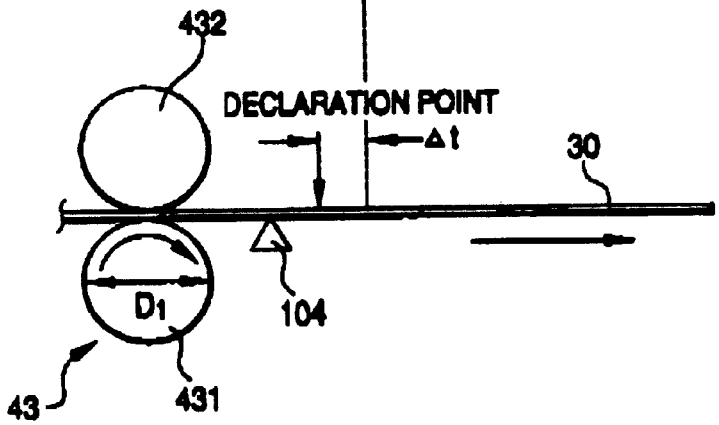
FIG. 24B is a diagram schematically showing a sheet transport control operation performed in the fourth embodiment when there occurs a change in the outer diameter of the registration drive roller.

If, however, the registration drive roller 431 expands due to an increase in its ambient temperature, the outer diameter of the registration drive roller 431 will become D1, for instance, which is larger than the reference outer diameter D0 as shown in FIG. 24B. Consequently, there occurs a displacement of the sheet 30 corresponding to the change in the outer diameter of the registration drive roller 431. In this case, the deceleration point is varied by as much as time $\Delta t$ to offset the amount of displacement of the sheet 30 due to the change in the outer diameter of the registration drive roller 431, so that the registration drive roller 431 is decelerated earlier than a case where it is decelerated when its outer diameter is equal to the reference outer diameter D0. Contrary to this, when the outer diameter D1 is smaller than the reference outer diameter D0, the deceleration point is delayed.

A specific example of a case where a displacement of the sheet 30 occurs due to change in the outer diameter of the registration drive roller 431 is given below. Here, it is assumed that the distance L2 between the registration outlet sensor 104 and the secondary image transfer part P is twice the circumference of the registration drive roller 431 whose reference outer diameter D0. If the outer diameter D of the registration drive roller 431 is Ø20 and it is made of urethane rubber, an increase in the outer diameter of the registration drive roller 431 ($\Delta D = D - D0$) which occurs when the ambient temperature of the registration drive roller 431 varies from 10° C. to 40° C. can be calculated using its thermal expansion coefficient. In this example, the outer diameter of the registration drive roller 431 increases by 0.90 mm and its circumference increases by 0.2827 mm. Therefore, the amount of displacement of the sheet 30 that occurs when it advances by the distance L2 is 0.5655 mm (0.2827×2 mm).

At this point, the sheet transport controller 100 calculates deceleration timing based on the location of the image 62 on the intermediate image transfer belt 20 and timing of passage of the sheet 30 over the registration outlet sensor 104, taking into account the amount of offset of the deceleration point in relation to the amount of displacement of the sheet 30 due to the change in the outer diameter of the registration drive roller 431.

Specifically, when the passage of the sheet 30 over the registration outlet sensor 104 is earlier than normal, the transport speed of the sheet 30 is decreased with correspondingly earlier timing. Contrary to this, when the passage of the sheet 30 over the registration outlet sensor 104 is later than normal, the transport speed of the sheet 30 is decreased with correspondingly delayed timing.

The aforementioned sheet transport speed switching operation is performed by controlling the turning speed of a drive motor 55 which drives the registration drive roller 431.

The method of measuring the outer diameter of the registration drive roller 431 is not limited to the above-described one. As an alternative, a method illustrated in FIG. 22B may be employed.

Figure 22B:
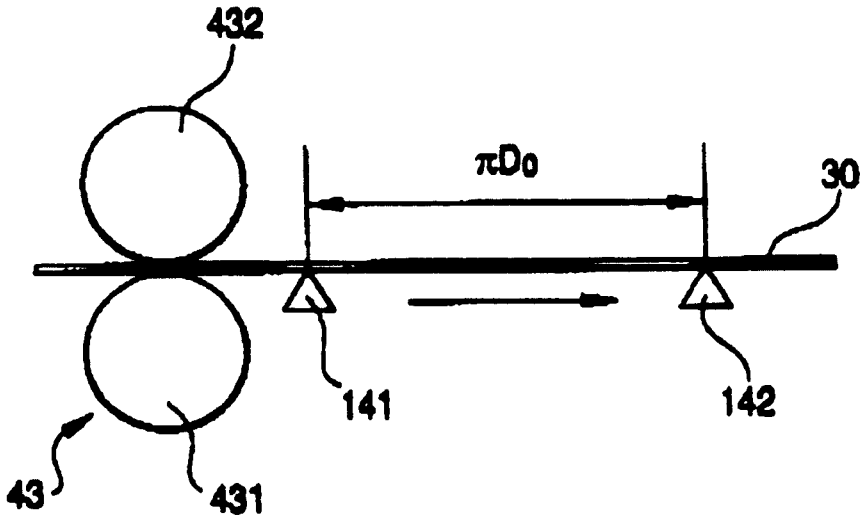
FIG. 22B is a diagram showing another method of recognizing a change in the outer diameter of the registration drive roller.

According to the method of FIG. 22B, two sheet passage sensors 141, 142 are disposed separately along a sheet path between the registration drive roller 431 and the secondary image transfer part P as illustrated, wherein the sheet passage sensor 141 may serve also as the registration outlet sensor 104, for example. The sheet transport controller 100 recognizes a change in the circumference of the registration drive roller 431 based on sensing signals taken in from these sheet passage sensors 141, 142.

The distance between the first sheet passage sensor 141 and the second sheet passage sensor 142 is made equal to the normal circumference ($\pi D0$) of the registration drive roller 431, where D0 represents the reference outer diameter of the registration drive roller 431. The sheet transport controller 100 recognizes the angle of rotation of the registration drive roller 431 by counting the number of drive pulses entered to the drive motor 55 while the sheet 30 passes between the sheet passage sensors 141 and 142, and thereby determines the amount of any change in the circumference of the registration drive roller 431.

Figure 25A:
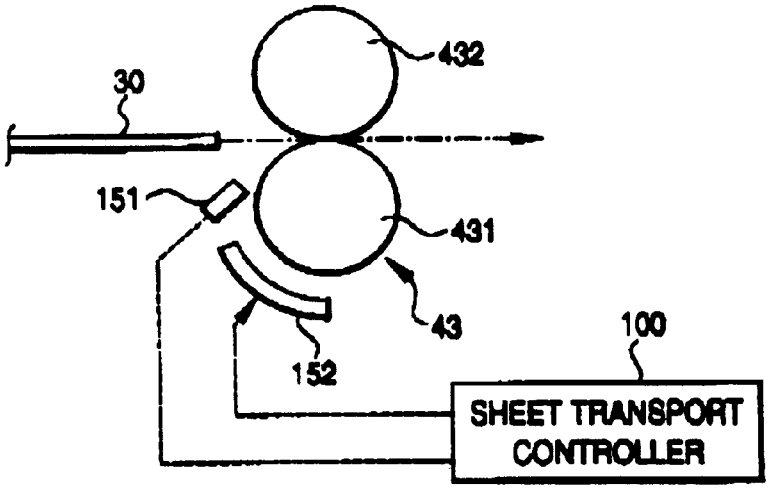
FIG. 25A is a diagram showing a variation of the fourth embodiment for avoiding changes in the outer diameter of the registration driver roller.
Figure 25B:
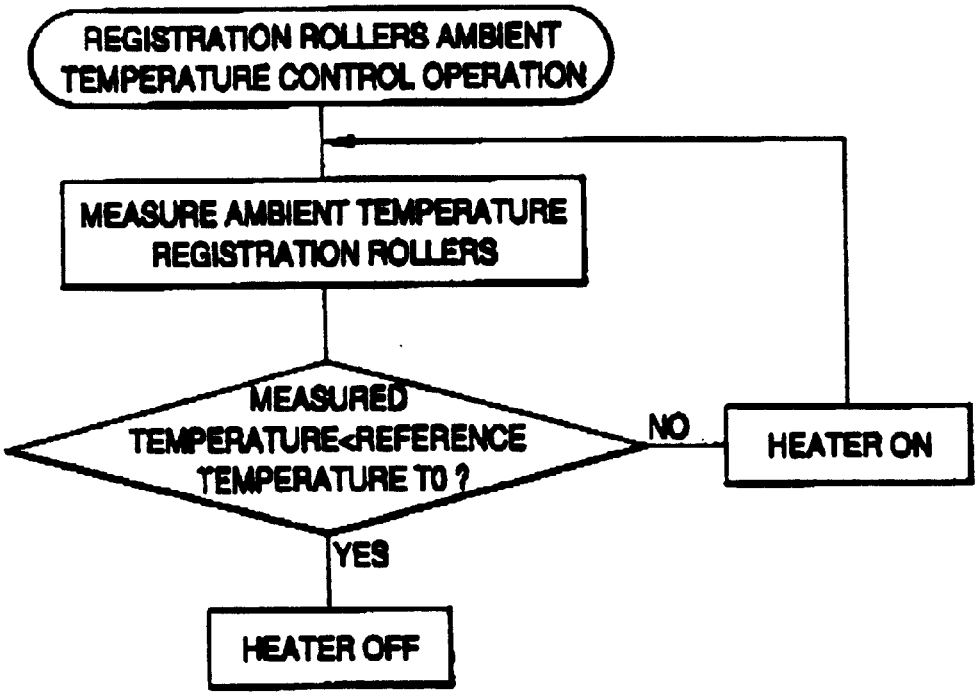
FIG. 25B is a flowchart showing a control operation performed in the variation of the fourth embodiment shown in FIG. 25A.

Furthermore, a sheet transport device used in the image-forming apparatus of this embodiment may be provided with a temperature sensor 151 in the vicinity of the registration roller pair 43 and a strip heater 152 extending close to the registration drive roller 431 in its axial direction as shown in FIG. 25A. With this arrangement, the sheet transport controller 100 keeps the ambient temperature of the registration roller pair 43 by turning on and off the strip heater 152 in a controlled manner based on temperature information entered from the temperature sensor 151, according to a flowchart shown in FIG. 25B. This arrangement makes it possible to avoid changes in the outer diameter of the registration drive roller 431.

VARIATIONS OF THE EMBODIMENTS

Although sheet registration mechanisms of the foregoing embodiments control the rotating speed of the registration roller pair 43 without stopping the sheet 30 midway in the sheet path, the invention is not limited thereto. Instead, any other appropriate method of controlling the rotating speed of the registration roller pair 43 may be employed in this invention.

Figure 26A:
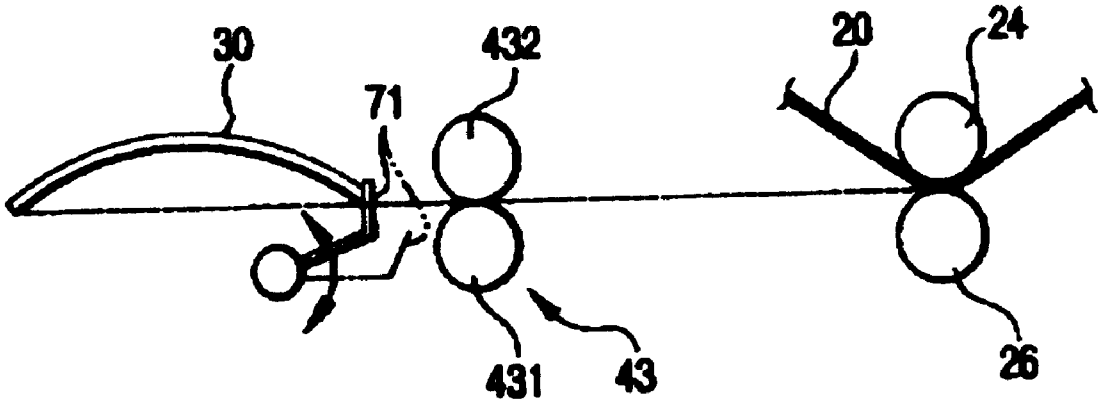
FIGS. 26A and 26B are diagrams showing alternative arrangements for registration of a sheet that can be implemented in the sheet transport devices of the first to fourth embodiment.

For example, FIG. 26A shows an alternative arrangement for registration of a sheet 30, in which a gate member 71 for registration is swingably supported upstream of a registration roller pair 43 such that the gate member 71 can open and close off a sheet path. The sheet 30 is once interrupted by the gate member 71 which is set in its closed position shown by solid lines. Then, the gate member 71 is switched to its open position shown by broken lines with specific timing to continue sheet transport operation.

Figure 26B:
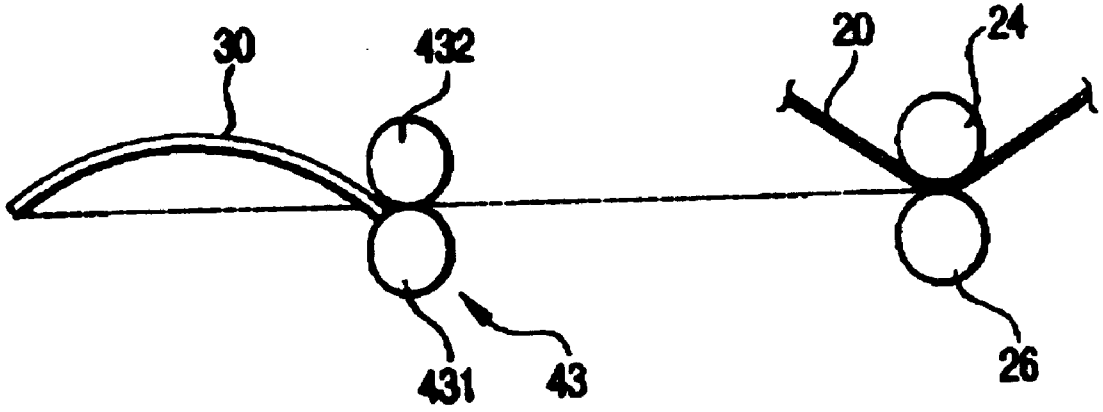

FIG. 26B shows a still alternative arrangement for registration of a sheet 30, in which the registration roller pair 43 is stopped prior to the arrival of the sheet 30 to temporarily stop the sheet 30 with its leading edge stuck in between registration rollers 431, 432, as illustrated. This alternative arrangement employs such a method of adjusting sheet restart timing that the registration drive roller 431 is restarted so that the sheet 30 is transported in synchronism with arrival time of an image (not shown) on an intermediate image transfer belt 20.

What is claimed is:

1. A sheet transport device comprising:

a sheet alignment mechanism, provided in a sheet path upstream of a target location, that moves a sheet in a direction perpendicular to a sheet transport direction to align the sheet to a reference position predefined for each set of sheet information including an initial side alignment and a reference position of at least 16.52 mm, 12.62 mm and 5.0 mm; and a registration/transport member fitted to the sheet alignment mechanism movably in the direction perpendicular to the sheet transport direction, provided in a sheet path upstream of a target location, that correctly positions a sheet in the sheet transport direction and transporting it toward the target location.

2. The sheet transport device according to claim 1, wherein the sheet alignment mechanism moves the registration/transport member from its home position in the direction perpendicular to the sheet transport direction with the sheet nipped by the registration/transport member.

3. The sheet transport device according to claim 2 wherein the registration/transport member is relieved of its state of nipping the sheet after a force advancing the sheet has been applied to it by a transport member disposed at the target location.

4. The sheet transport device according to claim 2 wherein the registration/transport member is relieved of its state of nipping the sheet and reset to the home position after a force advancing the sheet has been applied to it by a transport member disposed at the target location.

5. The sheet transport device according to claim 1, wherein the sheet alignment mechanism is a sheet-shifting mechanism provided upstream of the registration/transport member in the sheet transport direction, the sheet-shifting mechanism including a movable guide which shifts the sheet toward the reference position before it is nipped by the registration/transport member.

6. The sheet transport device according to claim 1 wherein the sheet alignment mechanism includes:

an initial alignment mechanism which aligns a side edge of the sheet to an initial side alignment position; and a reference position alignment mechanism which aligns the sheet initially aligned by the initial alignment mechanism to the reference position predefined for each set of sheet information.

7. The sheet transport device according to claim 6 wherein the initial alignment mechanism includes:

an initial side alignment position setting member which defines the initial side alignment position in the direction perpendicular to the sheet transport direction; and an oblique transport member which moves the sheet obliquely toward the initial side alignment position setting member.

8. The sheet transport device according to claim 1, wherein the sheet alignment mechanism comprises:

a memory that stores the reference position predefined for each set of sheet information; and a sheet-shifting mechanism which shifts the sheet in the direction perpendicular to the sheet transport direction to align the sheet to the reference position stored in the memory.

9. The sheet transport device according to claim 1, wherein the sheet alignment mechanism comprises:

a side edge position sensor which detects the location of a side edge of the sheet; and a sheet-shifting mechanism which determines a side shift amount required for the sheet to reach the reference position based on a sensing signal from the side edge position sensor and shifts the sheet in the direction perpendicular to the sheet transport direction as much as the side shift amount.

10. The sheet transport device, according to claim 1, wherein a sheet trimmer is provided in an aftertreatment unit which trims the sheet if it is of the A3 broad size, larger than the standard A3 size by cutting off its margins around an A3 image area.

11. An image-forming apparatus comprising:

an image carrier which carries an image formed to its image transfer part;

a sheet transport device which transports a sheet to the image transfer part of the image carrier; and an image transfer element which transfers the image on the image carrier onto the sheet at the image transfer part;

the sheet transport device comprising:

a sheet alignment mechanism, provided in a sheet path upstream of the image transfer part, that moves the sheet in a direction perpendicular to a sheet transport direction to align the sheet to a reference position for each set of sheet information including an initial side alignment and a reference position of at least 16.52 mm 12.62, and 5.0 mm; and a registration/transport member fitted to the sheet alignment mechanism movably in the direction perpendicular to the sheet transport direction, provided in a sheet path upstream of the image transfer part, that correctly positions the sheet in the sheet transport direction and transporting it toward the image transfer part.

12. The image-forming apparatus according to claim 11, wherein the sheet alignment mechanism has the capability of aligning a center line of the width of the sheet with a reference position which is taken at a center line of the width of the image carrier.

13. The image-forming apparatus according to claim 11, wherein the dimension of the image carrier as measured in the direction perpendicular to the sheet transport direction corresponds to that of a maximum image area, and wherein the sheet alignment mechanism aligns a center line of the width of the sheet with the reference position which is taken at a center line of the width of the image carrier at least when the sheet has a specific blank area around the maximum image area.

14. The image-forming apparatus according to claim 13, wherein the sheet alignment mechanism aligns a side edge of the sheet to a side reference position when the sheet is smaller than the maximum image area.

15. The image-forming apparatus according to claim 11 wherein the sheet alignment mechanism can change the reference position predefined for each set of sheet information.

16. The image-forming apparatus, according to claim 11, wherein the sheet transport device provides a sheet trimmer provided in an aftertreatment unit which trims the sheet if it is of the A3 broad size, larger than the standard A3 size by cutting off its margins around an A3 image area.

* * * * *